US012653362B2

(12) United States Patent
Conrad

(10) Patent No.: US 12,653,362 B2
(45) Date of Patent: Jun. 16, 2026

(54) EVACUATION STATION FOR A MOBILE FLOOR CLEANING ROBOT

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 336 days.

(21) Appl. No.: 18/221,865

(22) Filed: Jul. 13, 2023

(65) Prior Publication Data

US 2023/0355058 A1 Nov. 9, 2023

Related U.S. Application Data

(63) Continuation of application No. 17/111,872, filed on Dec. 4, 2020, now Pat. No. 11,737,625.

(51) Int. Cl.

| | |
|---|---|
| ***A47L 9/14*** | (2006.01) |
| ***A47L 9/00*** | (2006.01) |
| ***A47L 9/12*** | (2006.01) |
| ***A47L 9/16*** | (2006.01) |

(52) U.S. Cl.
CPC ..... *A47L 9/149* (2013.01); *A47L 9/0063* (2013.01); *A47L 9/12* (2013.01); *A47L 9/1683* (2013.01); *A47L 2201/024* (2013.01)

(58) Field of Classification Search
CPC ..... A47L 9/149; A47L 9/0063; A47L 9/12; A47L 9/1683; A47L 2201/024
See application file for complete search history.

(56) References Cited

U.S. PATENT DOCUMENTS

| | | | | |
|---|---|---|---|---|
| 3,543,325 A | | 12/1970 | Hamrick | |
| 3,572,799 A | | 3/1971 | Truesdell et al. | |
| 3,635,739 A | | 1/1972 | Macdowell et al. | |
| 3,695,159 A | | 10/1972 | Mita | |
| 3,984,708 A | | 10/1976 | Holmlund et al. | |
| 4,547,927 A | * | 10/1985 | Berfield | A47L 9/00 15/327.2 |
| 4,864,683 A | * | 9/1989 | Herron, Jr. | A47L 9/0081 181/207 |

(Continued)

FOREIGN PATENT DOCUMENTS

| | | | |
|---|---|---|---|
| CA | 978485 | A | 11/1975 |
| CA | 2275675 | A1 | 12/1999 |

(Continued)

OTHER PUBLICATIONS

International Search Report and Written Opinion received in connection to co-pending international patent application No. PCT/CA2019/051431, mailed on Jan. 2, 2020.

(Continued)

*Primary Examiner* — Marc Carlson
(74) *Attorney, Agent, or Firm* — Philip C. Mendes da Costa; SMART & BIGGAR LP

(57) ABSTRACT

An evacuation station for a surface cleaning apparatus comprises a stationary base portion and an removable portion comprising an air treatment assembly that is moveably mounted to the stationary base portion. A pre-motor filter is exposed when the removably portion is removed from the stationary portion.

20 Claims, 26 Drawing Sheets

(56) References Cited

U.S. PATENT DOCUMENTS 5,135,552 A * 8/1992 Weistra ..... A47L 9/1625 55/343
5,267,371 A 12/1993 Soler et al.
5,327,741 A 7/1994 Mason et al.
5,358,290 A 10/1994 Fleet et al.
5,389,329 A 2/1995 Watanabe et al.
5,787,545 A 8/1998 Colens
5,974,625 A 11/1999 Garner
6,098,244 A 8/2000 Conrad et al.
6,099,661 A 8/2000 Conrad
6,101,672 A 8/2000 Conrad et al.
6,123,779 A 9/2000 Conrad et al.
6,129,775 A 10/2000 Conrad et al.
6,135,708 A 10/2000 Conrad et al.
6,168,716 B1 1/2001 Conrad et al.
6,170,119 B1 1/2001 Conrad et al.
6,173,474 B1 1/2001 Conrad
6,174,127 B1 1/2001 Conrad et al.
6,183,641 B1 2/2001 Conrad et al.
6,224,325 B1 5/2001 Conrad et al.
6,231,645 B1 5/2001 Conrad et al.
6,238,177 B1 5/2001 Conrad et al.
6,243,917 B1 6/2001 Conrad
6,251,296 B1 6/2001 Conrad et al.
6,261,052 B1 7/2001 Conrad et al.
6,261,379 B1 7/2001 Conrad et al.
6,280,143 B1 8/2001 Parker et al.
6,307,358 B1 10/2001 Conrad
6,312,594 B1 11/2001 Conrad et al.
6,328,527 B1 12/2001 Conrad et al.
6,334,234 B1 1/2002 Conrad et al.
6,344,064 B1 2/2002 Conrad
6,440,197 B1 8/2002 Conrad et al.
6,457,205 B1 10/2002 Conrad
6,533,834 B2 3/2003 Conrad et al.
6,599,340 B2 7/2003 Conrad et al.
6,611,989 B2 * 9/2003 Oh ..... A47L 9/26 15/326
6,782,585 B1 8/2004 Conrad et al.
6,818,036 B1 * 11/2004 Seaman ..... A47L 9/1633 15/340.1
7,053,578 B2 * 5/2006 Diehl ..... G05D 1/0242 446/175
7,247,181 B2 7/2007 Hansen et al.
7,329,294 B2 2/2008 Conrad
7,412,748 B2 8/2008 Lee et al.
7,473,289 B2 1/2009 Oh et al.
7,488,362 B2 * 2/2009 Jeong ..... B04C 5/185 55/343
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,849,555 B2 12/2010 Hahm et al.
7,861,366 B2 * 1/2011 Hahm ..... A47L 9/009 15/328
7,867,308 B2 1/2011 Conrad
7,887,613 B2 2/2011 Ruben
7,941,895 B2 5/2011 Conrad
8,127,398 B2 3/2012 Conrad
8,146,201 B2 4/2012 Conrad
8,151,407 B2 4/2012 Conrad
8,176,596 B2 5/2012 Conrad
8,192,515 B2 6/2012 Conrad
8,292,979 B2 10/2012 Conrad
8,296,900 B2 10/2012 Conrad
8,349,428 B2 1/2013 Conrad
8,370,993 B2 2/2013 Conrad
8,375,508 B2 2/2013 Conrad
8,448,291 B2 5/2013 Conrad
8,479,358 B2 7/2013 Conrad
8,486,170 B2 7/2013 Conrad et al.
8,510,907 B2 8/2013 Conrad
8,533,904 B2 9/2013 Conrad
8,561,257 B2 10/2013 Conrad
8,567,005 B2 10/2013 Conrad
8,572,799 B2 * 11/2013 Won ..... A47L 11/4002 15/352
8,578,550 B2 11/2013 Conrad
8,578,553 B2 11/2013 Conrad
8,590,102 B2 11/2013 Conrad
8,607,407 B2 12/2013 Conrad
8,621,709 B2 1/2014 Conrad
8,640,304 B2 2/2014 Conrad
8,646,147 B2 2/2014 Conrad
8,659,184 B2 2/2014 Conrad
8,677,554 B2 3/2014 Conrad
8,677,558 B2 3/2014 Conrad
8,713,751 B2 5/2014 Conrad
8,756,751 B2 * 6/2014 Jung ..... A47L 9/2805 15/319
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
8,984,708 B2 * 3/2015 Kuhe ..... A47L 5/24 15/319
9,027,198 B2 5/2015 Conrad
9,027,203 B2 5/2015 Conrad et al.
9,066,642 B2 6/2015 Conrad
9,119,513 B2 9/2015 Conrad
9,161,666 B2 10/2015 Conrad
9,161,669 B2 10/2015 Conrad
9,167,944 B2 10/2015 Conrad
9,192,272 B2 11/2015 Ota
9,204,769 B2 12/2015 Conrad
9,204,773 B2 12/2015 Conrad
9,215,960 B2 12/2015 Conrad
9,226,633 B2 1/2016 Conrad et al.
9,227,151 B2 1/2016 Conrad
9,227,201 B2 1/2016 Conrad
9,232,881 B2 1/2016 Conrad
9,238,235 B2 1/2016 Conrad
9,295,995 B2 3/2016 Conrad
9,314,138 B2 4/2016 Conrad
9,314,139 B2 4/2016 Conrad et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,855 B2 9/2016 Conrad
9,456,721 B2 10/2016 Conrad
9,462,920 B1 * 10/2016 Morin ..... A47L 9/149
9,492,045 B2 11/2016 Conrad
9,492,048 B2 11/2016 Won et al.
9,526,391 B2 * 12/2016 Lee ..... A47L 11/4025
9,526,394 B2 12/2016 Conrad
9,572,463 B2 2/2017 Conrad
9,591,952 B2 3/2017 Conrad
9,591,958 B2 3/2017 Conrad
9,775,484 B2 10/2017 Conrad
9,788,698 B2 * 10/2017 Morin ..... A47L 9/106
9,801,513 B2 10/2017 Conrad et al.
9,820,621 B2 11/2017 Conrad et al.
9,888,818 B2 2/2018 Kuhe et al.
9,907,447 B2 * 3/2018 Tanaka ..... A47L 9/106
9,931,007 B2 * 4/2018 Morin ..... A47L 9/127
10,022,029 B2 * 7/2018 Machida ..... A47L 9/2884
10,076,183 B2 9/2018 Conrad et al.
10,149,587 B2 12/2018 Conrad et al.
10,159,393 B2 12/2018 Conrad
10,201,260 B2 2/2019 Conrad et al.
10,214,349 B2 2/2019 Conrad
10,251,519 B2 4/2019 Conrad
10,357,136 B2 7/2019 Conrad
10,537,216 B2 1/2020 Conrad

(56) References Cited

U.S. PATENT DOCUMENTS 10,537,219 B2 1/2020 Conrad et al.
10,568,477 B2 2/2020 Conrad
10,575,693 B2 3/2020 Conrad
10,595,696 B2 3/2020 Harting et al.
10,667,663 B2 6/2020 Conrad
10,687,679 B2 6/2020 Conrad et al.
10,729,294 B2 8/2020 Conrad et al.
10,791,890 B2 10/2020 Conrad
10,791,896 B2 10/2020 Conrad
10,888,205 B2 1/2021 Conrad et al.
10,932,634 B2 3/2021 Conrad
10,959,588 B2 3/2021 Conrad et al.
11,013,378 B2 5/2021 Conrad
11,108,254 B2 8/2021 Conrad
11,135,602 B2 10/2021 Conrad
11,154,169 B2 10/2021 Conrad
11,198,085 B2 12/2021 Conrad et al.
11,213,179 B2 1/2022 Conrad
11,246,462 B2 2/2022 Conrad
11,285,495 B2 3/2022 Conrad
11,318,482 B2 5/2022 Conrad
11,478,116 B2 10/2022 Conrad
11,478,117 B2 10/2022 Conrad et al.
11,529,034 B2 12/2022 Conrad
11,534,041 B2 12/2022 Conrad
11,534,043 B2 12/2022 Conrad
11,534,702 B2 12/2022 Conrad
11,547,258 B2 1/2023 Conrad
11,571,097 B2 2/2023 Conrad
11,607,099 B2 3/2023 Conrad
11,612,290 B2 3/2023 Conrad
11,617,488 B2 4/2023 Conrad
11,745,131 B2 9/2023 Conrad
11,793,374 B2 10/2023 Conrad
11,839,343 B2 12/2023 Conrad et al.
11,857,142 B2 1/2024 Conrad
11,950,745 B2 4/2024 Conrad et al.
2001/0027587 A1 10/2001 Conrad et al.
2002/0124343 A1 9/2002 Reed
2002/0162188 A1 11/2002 Harmen
2003/0201754 A1 10/2003 Conrad
2004/0216266 A1 11/2004 Conrad
2005/0150519 A1 7/2005 Keppler et al.
2006/0037170 A1 2/2006 Shimizu
2006/0196004 A1 9/2006 Conrad
2007/0226949 A1* 10/2007 Hahm ..... A47L 9/009 15/340.1
2008/0172992 A1 7/2008 Conrad
2008/0178416 A1 7/2008 Conrad
2008/0178418 A1 7/2008 Conrad
2008/0179133 A1 7/2008 Conrad
2008/0196366 A1 8/2008 Conrad
2008/0201895 A1* 8/2008 Kim ..... A47L 9/106 901/1
2008/0216281 A1 9/2008 Conrad
2010/0175217 A1 7/2010 Conrad
2010/0229323 A1 9/2010 Conrad
2010/0229325 A1 9/2010 Conrad
2010/0229326 A1 9/2010 Conrad
2010/0229334 A1 9/2010 Conrad
2010/0229335 A1 9/2010 Conrad
2010/0251507 A1 10/2010 Conrad
2011/0219567 A1 9/2011 Conrad
2011/0219579 A1 9/2011 Conrad
2012/0011676 A1 1/2012 Jung et al.
2012/0013907 A1 1/2012 Jung et al.
2012/0102670 A1 5/2012 Jang et al.
2012/0291809 A1 11/2012 Kuhe et al.
2013/0056026 A1 3/2013 Jung et al.
2013/0305481 A1* 11/2013 Jung ..... A47L 11/33 15/301
2014/0059983 A1* 3/2014 Ho ..... A47L 9/1625 55/343
2014/0237768 A1 8/2014 Conrad
2016/0166126 A1 6/2016 Morin et al.
2016/0183752 A1* 6/2016 Morin ..... A47L 9/19 15/340.1
2016/0278596 A1 9/2016 Janzen et al.
2016/0374528 A1 12/2016 Morin et al.
2017/0150861 A1* 6/2017 Tanaka ..... A47L 9/28
2017/0196430 A1* 7/2017 Machida ..... A47L 7/0047
2017/0319038 A1* 11/2017 Kim ..... A47L 5/28
2018/0000302 A1* 1/2018 Hyun ..... A47L 9/1616
2018/0014709 A1* 1/2018 O'Brien ..... A47L 9/2884
2018/0078107 A1 3/2018 Gagnon et al.
2018/0199776 A1 7/2018 Sato et al.
2018/0228335 A1 8/2018 Miller
2019/0059680 A1* 2/2019 Fox ..... A47L 11/4011
2019/0202064 A1* 7/2019 Wolff ..... G05D 1/0225
2020/0000301 A1 1/2020 Morin et al.
2020/0022553 A1* 1/2020 Gill ..... A47L 9/1463
2020/0069139 A1 3/2020 Johnson et al.
2020/0077851 A1 3/2020 Kashihara
2020/0122164 A1* 4/2020 Conrad ..... A47L 9/1641
2020/0179953 A1 6/2020 Conrad
2020/0281430 A1* 9/2020 Morin ..... A47L 9/009
2020/0288930 A1 9/2020 Wells
2020/0305671 A1 10/2020 Conrad
2021/0228032 A1 7/2021 Conrad
2021/0330157 A1 10/2021 Conrad
2021/0330167 A1* 10/2021 Conrad ..... A47L 11/4027
2021/0330168 A1 10/2021 Conrad
2021/0386258 A1 12/2021 Conrad
2022/0015593 A1* 1/2022 Conrad ..... A47L 9/165
2022/0015594 A1* 1/2022 Conrad ..... A47L 9/12
2022/0061614 A1* 3/2022 Yu ..... A47L 9/0072
2022/0095862 A1 3/2022 Kim et al.
2022/0142440 A1 5/2022 Conrad
2022/0151446 A1 5/2022 Conrad et al.
2023/0098664 A1 3/2023 Conrad
2023/0255418 A1* 8/2023 Choi ..... A47L 9/1409 15/319
2023/0263350 A1 8/2023 Conrad et al.
2023/0348169 A1 11/2023 Conrad
2024/0016351 A1 1/2024 Conrad
2024/0138634 A1 5/2024 Conrad
2024/0180373 A1 6/2024 Conrad et al.
2024/0358212 A1 10/2024 Conrad

FOREIGN PATENT DOCUMENTS

CA 2288544 A1 5/2000
CA 2258416 A1 7/2000
CA 2258419 A1 7/2000
CA 2258421 A1 7/2000
CA 2258422 A1 7/2000
CA 2258423 A1 7/2000
CA 2258426 A1 7/2000
CA 2330801 A1 7/2001
CA 2338193 A1 7/2002
CA 2339514 A1 9/2002
CA 2342673 A1 9/2002
CA 2342993 A1 9/2002
CA 2492737 A1 11/2005
CA 2658014 A1 9/2010
CA 2658022 A1 9/2010
CA 2658160 A1 9/2010
CA 2658366 A1 9/2010
CA 2658397 A1 9/2010
CA 2658497 A1 9/2010
CA 2658643 A1 9/2010
CA 2658644 A1 9/2010
CA 2972252 A1 * 6/2016
CN 1212095 C 7/2005
CN 201669842 U * 12/2010
CN 114983270 A 9/2022
DE 102014100358 A1 7/2015
EP 1243218 B1 5/2010
EP 1707094 B1 4/2012
EP 2564749 A1 * 3/2013 ..... A47L 11/33
EP 3669733 A1 * 6/2020 ..... A47L 9/106
GB 539973 A 10/1941
GB 2467403 A 8/2010
GB 2522658 B 4/2016

(56) References Cited

FOREIGN PATENT DOCUMENTS

| | | | | | |
|---|---|---|---|---|---|
| JP | 2003180587 | A | | 7/2003 | |
| JP | 2004267236 | A | * | 9/2004 | ..... A47L 9/2852 |
| JP | 2014058186 | A | * | 4/2014 | |
| JP | 2016015975 | A | * | 2/2016 | ..... A47L 9/10 |
| KR | 1020070012109 | A | | 1/2007 | |
| KR | 2011041721 | A | * | 4/2011 | |
| WO | 0010718 | A1 | | 3/2000 | |
| WO | WO-2017173423 | A1 | * | 10/2017 | ..... H02J 7/0044 |
| WO | WO-2022114500 | A1 | * | 6/2022 | ..... A47L 9/2805 |

OTHER PUBLICATIONS

English machine translation of KR1020070012109A, published on Jan. 25, 2007.
English machine translation of JP2003180587A, published on Jul. 2, 2003.
English machine translation of CN1212095, published on Jul. 27, 2005.
English machine translation of EP1243218B1, published on May 19, 2010.
U.S. Appl. No. 09/343,479, filed Jun. 30, 1999.
English machine translation of DE102014100358, published on Jul. 16, 2015.
English machine translation of CN114983270, published on Sep. 2, 2023.

* cited by examiner

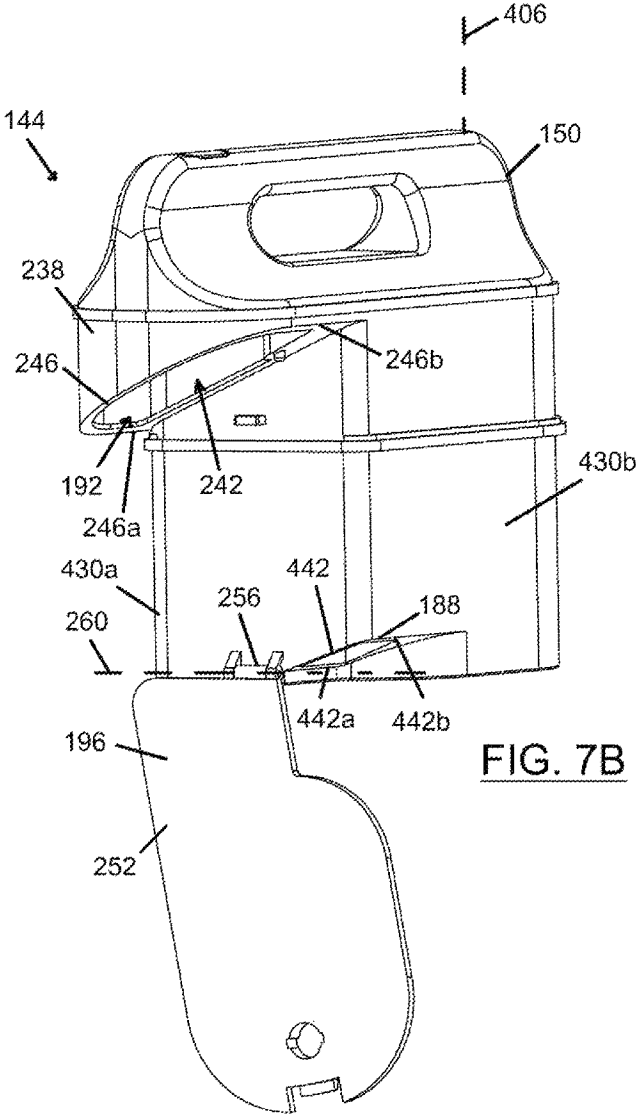
FIG. 7B
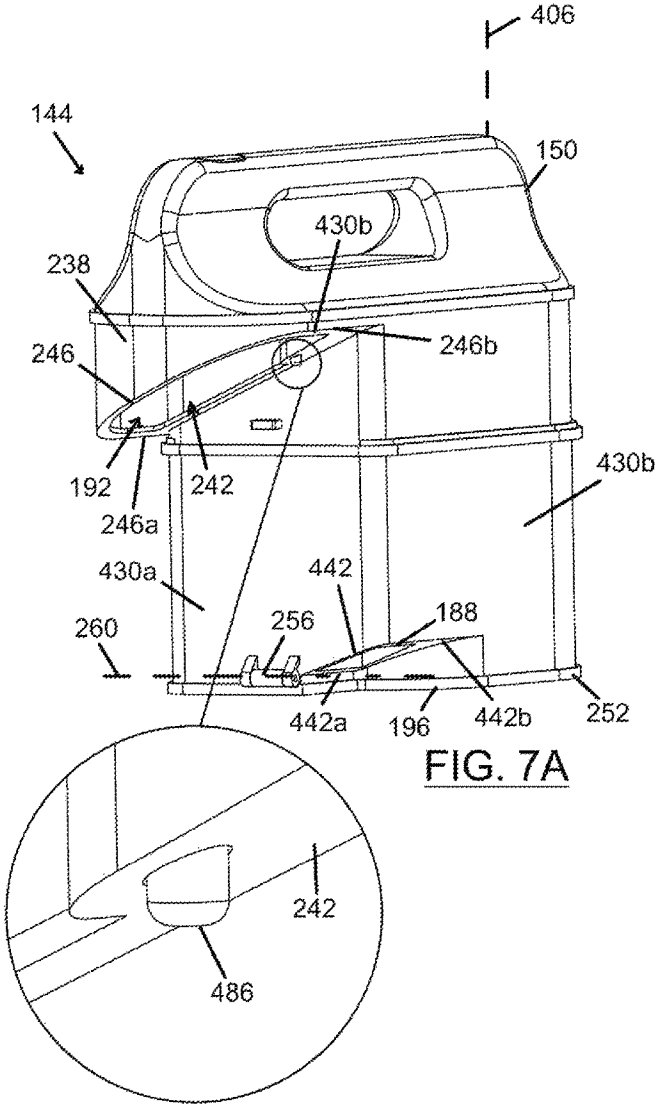
FIG. 7A
FIG. 7C

EVACUATION STATION FOR A MOBILE FLOOR CLEANING ROBOT

CROSS REFERENCE TO RELATED APPLICATIONS

This application is a continuation of U.S. patent application Ser. No. 17/111,872, which was filed on Dec. 4, 2020, which is allowed, the disclosure of which is incorporated herein.

FIELD

The field of disclosure relates generally to evacuation or docking stations to empty a surface cleaning apparatus, such as a robotic or mobile surface cleaning apparatus.

INTRODUCTION

Various types of robotic surface cleaning apparatus are known. Robotic surface cleaning apparatus, which can also be referred to as robotic vacuum cleaners or robotic cleaners, may have an evacuation station (or docking station) that charges the robotic vacuum cleaner when the robotic vacuum cleaner is connected to (or docked at) the docking station. Also, the evacuation station may have means to empty a dirt collection chamber of a robotic surface cleaning apparatus.

SUMMARY OF VARIOUS EMBODIMENTS

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with a broad aspect of this disclosure, an evacuation station is provided which facilitates quick emptying of a robotic surface cleaning device. In particular, a robotic cleaner may at times dock (or connect) to the evacuation station (e.g., in-between cleaning cycles, when the robotic cleaner requires recharging, etc.), and the evacuation station may be operated to empty all, or a portion, of dirt and debris accumulated inside the robotic cleaner. In this manner, the evacuation station may empty the robotic cleaner without requiring a user to remove a dirt collection container from the robotic cleaner each time it is desired to empty dirt and debris from the robotic cleaner.

Over multiple instances of docking (or connecting) the robotic cleaner to the evacuation station, the evacuation station may, itself, require emptying or cleaning. To facilitate emptying or cleaning of the evacuation station, the evacuation station may comprise a removable portion and a stationary base portion. The removable portion may comprise at least a dirt collection region or chamber which aggregates dirt and debris transferred from the robotic cleaner into the evacuation station, and it may comprise an air treatment assembly which separates dirt and debris entrained in air transferred from the robotic cleaner into the evacuation station and which aggregates the dis-entrained dirt and debris.

To clean the evacuation station, a user may remove (e.g., lift-away) the removable portion from the stationary base portion. This may allow, for example, the user to transport the removable portion and empty its dirt contents (i.e., to an external dirt bin such as a garbage can), before re-mounting the removable portion to the stationary base. Accordingly, the user is not required to transport the entire evacuation station each time it is desired to empty dirt and debris from the docking station.

To assist users in mounting (or re-mounting) the removable portion to the stationary base, the evacuation station may include an alignment mechanism. The alignment mechanism may enable the removable portion to be correctly aligned when the removable portion is placed back on the stationary base such that the removable portion may be connected in fluid communication with the stationary base when the removable portion is placed in an in-use or mounted position.

In exemplified embodiments, the alignment mechanism may comprise one or more "alignment pins" and corresponding "pin-receiving holes". The alignment pins may be located on the stationary base, while the pin-receiving holes may be disposed on the removable portion, or vice-versa. In this configuration, when the alignment pin is correctly aligned (i.e., positioned) with respect to the corresponding pin-receiving holes, the removable portion may be placed into the in-use position.

Optionally, a locking mechanism is also provided to secure the removable portion to the stationary base in the operational position. For example, the removable portion may rotate about the alignment pin between a locked "in-use position" and an un-locked "removable position".

In the locked in-use position, the locking mechanism locks the removable portion in fluid communication with the stationary base. The removable portion may be unlocked and rotated, relative to the stationary base, to the un-locked removable position, such that the locking mechanism unlocks the removable portion, and the removable portion may be detached (e.g., lifted-away) from the stationary base. In some embodiments, the locking mechanism may be integrated into an alignment pin of the alignment mechanism. Optionally, the removable portion may be unlocked once rotated, relative to the stationary base, to the un-locked removable position.

An advantage of the locking mechanism is that it may prevent the removable portion from being inadvertently dismounted from the stationary base in the in-use position (e.g., during operation of the evacuation station). Rather, a user must actively rotate the removable portion into the removable position before dismounting (e.g., lifting-away) the removable portion.

In accordance with these aspects of this disclosure, there is provided an evacuation station for a mobile floor cleaning robot, the evacuation station comprising:

a) an air flow path extending from an evacuation station air inlet to an evacuation station air outlet;

b) a stationary base portion having an upper surface; and, c) an air treatment assembly comprising an air treatment member, wherein the air treatment assembly is rotatable from an in-use position to a removable position in which all of the air treatment assembly is removable from the stationary base portion.

In some embodiments, the evacuation station air inlet may be provided in the stationary base portion and the evacuation station air inlet may be in fluid communication with an outlet port of the mobile floor cleaning robot when the mobile floor cleaning robot is docked with the evacuation station.

In some embodiments, the air treatment assembly may have an air inlet and, in the in-use position, the air treatment assembly air inlet may be downstream from the evacuation station air inlet.

In some embodiments, the air flow path may comprise an air treatment member reed path extending from the evacuation station air inlet to an outlet port and the air treatment assembly air inlet may be provided in a lower portion of the air treatment assembly and may sealingly engage the outlet port when the air treatment assembly is rotated to the in-use position.

In some embodiments, in the in-use position, the air treatment assembly may overlie the upper surface of the stationary base portion and the outlet port may be provided adjacent the upper surface.

In some embodiments, a suction motor and the evacuation station air outlet may each be provided in the stationary base portion.

In some embodiments, the air treatment assembly may have an air inlet and an air outlet and, in the in-use position, the air treatment assembly air inlet may be downstream from the evacuation station air inlet and the air treatment assembly air outlet may be upstream from the evacuation station air outlet.

In some embodiments, the air treatment member may comprise a momentum air separator, a pre-motor filter media may be provided in the air flow path downstream of the momentum air separator, and the pre-motor filter media may be accessible when the air treatment assembly is removed from the stationary base portion.

In some embodiments, the momentum air separator may comprise at least one cyclone.

In some embodiments, the stationary base portion may further comprise a per-motor filter provided in a pre-motor filter housing, and an upper end of the pre-motor filter housing may be opened when the air treatment assembly is removed from the stationary base portion.

In some embodiments, the stationary base portion may further comprise a suction motor positioned in the air flow path below the pre-motor filter.

In some embodiments, the upper surface of the stationary base portion may have an alignment pin and, the air treatment assembly may have a recess in which the alignment pin is removably receivable wherein, when the air treatment assembly is positioned on the stationary base portion, the air treatment assembly may be rotatably seated on the alignment pin.

In some embodiments, the air treatment assembly may have a lower openable door.

In some embodiments, the stationary base portion may have a front robot docking side, a rear side and two laterally opposed ends and the upper surface may be provided on one lateral end and a pre-motor filter housing is provided on the other lateral end.

In some embodiments, the stationary base portion may further comprise a suction motor positioned in the air flow path below the pre-motor filter housing.

In some embodiments, the air treatment assembly may have an air inlet and an air outlet and, in the in-use position, the air treatment assembly air inlet may be downstream from the evacuation station air inlet and the air treatment assembly air outlet may be provided in an upper end of the air treatment assembly.

In some embodiments, in the in-use position, a portion of the upper end of the air treatment assembly may overlie the pre-motor filter housing.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which:

FIG. 7A is a side-rear perspective view of the air treatment assembly, and showing a bottom openable door in a closed position;

FIG. 7B is a side-rear perspective view of the air treatment assembly, and showing the bottom openable door an opened position;

FIG. 7C is a close-up view of a locking pin of the air treatment assembly;

Figure 1B:
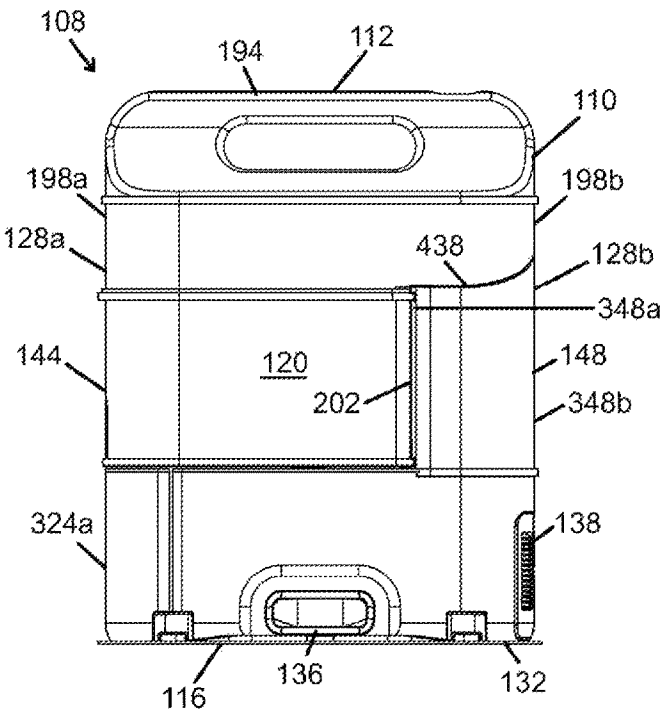
FIG. 1B is a front elevation view of the evacuation station.

The drawings included herewith are for illustrating various examples of articles, methods, and apparatuses of the teaching of the present specification and are not intended to limit the scope of what is taught in any way.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other.

None of the terms "coupled", "connected", "attached", and "fastened" distinguish the manner in which two or more parts are joined together.

Some elements herein may be identified by a part number, which is composed of a base number followed by an alphabetical or subscript-numerical suffix (e.g. 112*a,* or 112$_1$). Multiple elements herein may be identified by part numbers that share a base number in common and that differ by their suffixes (e.g. 112$_1$, 112$_2$, and 112$_3$). All elements with a common base number may be referred to collectively or generically using the base number without a suffix (e.g. 112).

General Description of an Evacuation Station

With reference to FIGS. 1-2, the following is a general discussion of embodiments of an evacuation station 108 (also referred to herein as a docking station), which provides a basis for understanding several features that are discussed herein. As discussed subsequently, each of the features may be used individually or in any particular combination or sub-combination such as in the embodiments disclosed herein.

Figure 1A:
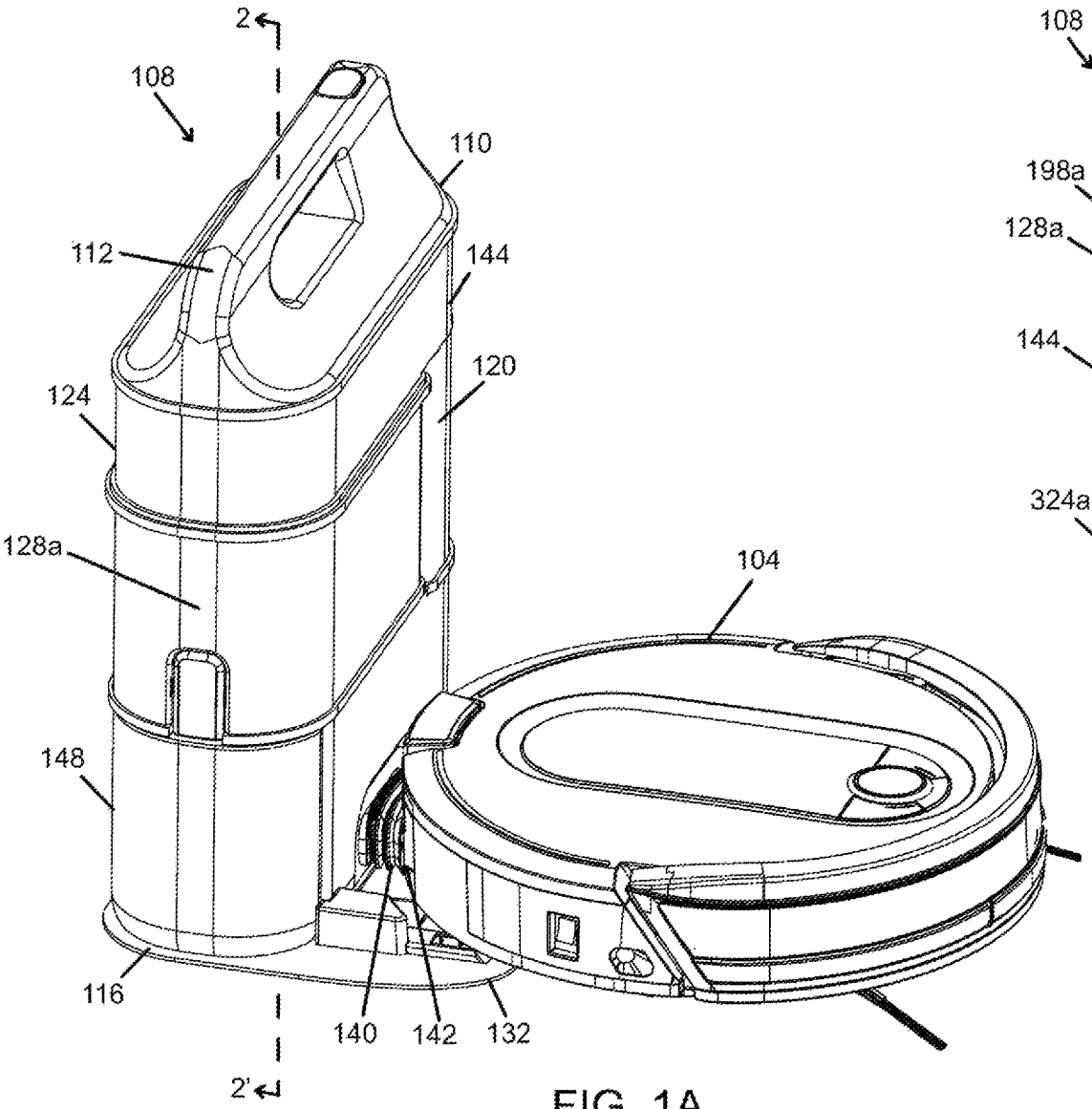
FIG. 1A is a front-side perspective view of a robotic vacuum cleaner docked at an evacuation station.

In the course of cleaning, and during periods of inactivity, a robotic vacuum cleaner 104 (also referred to herein as a robot vacuum cleaner, or a mobile floor cleaning robot) may, at times, dock (or connect) to the evacuation station 108 (FIG. 1A). The evacuation station 108 can facilitate quick emptying of dirt and debris accumulated during a cleaning operation from the robotic vacuum cleaner 104. Once some, or all, of the dirt and debris has been transferred out of the robotic vacuum cleaner, the evacuation station 108 may be independently emptied. In this manner, the evacuation station 108 may facilitate safe and fast emptying of the robotic surface cleaning device 104 without requiring a user to remove a dirt collection container from the robotic vacuum cleaner each time it is desired to empty out dirt and debris. In various cases, evacuation station 108 can also be used to re-charge a battery of the robotic vacuum cleaner 104 during docking.

As best exemplified in FIGS. 1A-1D, the evacuation station 108 may generally include a housing body 110 having an upper end 112, an opposed lower end 116, a front face 120, an opposed rear face 124, as well as lateral-side faces 128*a,* 128*b*.

The housing body 110 may have any suitable shape or design. For instance, in the exemplified embodiments, the housing body 110 has a generally vertical up-right design. Optionally, the lower end 116 of the station 108 can comprise a base platform 132 for supporting the station 108 in the vertical up-right position.

As provided herein, to transfer dirt from a docked robot 104 into the evacuation station 108, the evacuation station 108 may be operable to generate a suction force of air. In particular, the evacuation station 108 can include an evacuation station air inlet 136 (also referred herein as a dirt inlet port, or a dirt air inlet), and an evacuation station air outlet 138 (also referred herein as a clean air outlet).

Air inlet 136 may be configured, during operation of the station 108, to accommodate an incoming stream of dirty air that includes, for example, coarse and fine dirt, solid debris as well as other air-borne containments from the docked robot (which may be referred to as dirt). Airflow received through the air inlet 136 travels into the station 108 and passes through one or more separating stages that separate the flow of air from air-borne dirt contained therein. Relatively cleaner air may then exit the station 108 through the air outlet 138, located downstream from the air inlet 136.

Air inlet 136 and air outlet 138 may be provided at any suitable location around the station body 110. For instance—as exemplified—the air inlet 136 may be disposed at the front face 120 of the evacuation station body 110. In this position, the air inlet 136 is positioned to be in fluid flow communication (e.g., it may be aligned) with an opening port 142—or a dirt outlet port—of the robot cleaner 104. Further, the clean air outlet 138 may be optionally positioned at a lateral-side face 128*b* of station body 110.

Optionally, a sealing member 140 (e.g., a bellows or the like) is provided, e.g., around the inlet port 136. Upon docking the robot 104, the sealing member 140 may engage around the robot outlet port 142 to prevent dirt and debris from escaping during transferring of dirt from the robot 104 to the evacuation station 108.

In other embodiments, the evacuation station 108 may not require suction force to transfer dirt from the robot 104 but can otherwise employ any other suitable dirt transfer mechanism (e.g., a mechanical dirt transfer mechanism, etc.).

Figure 2A:
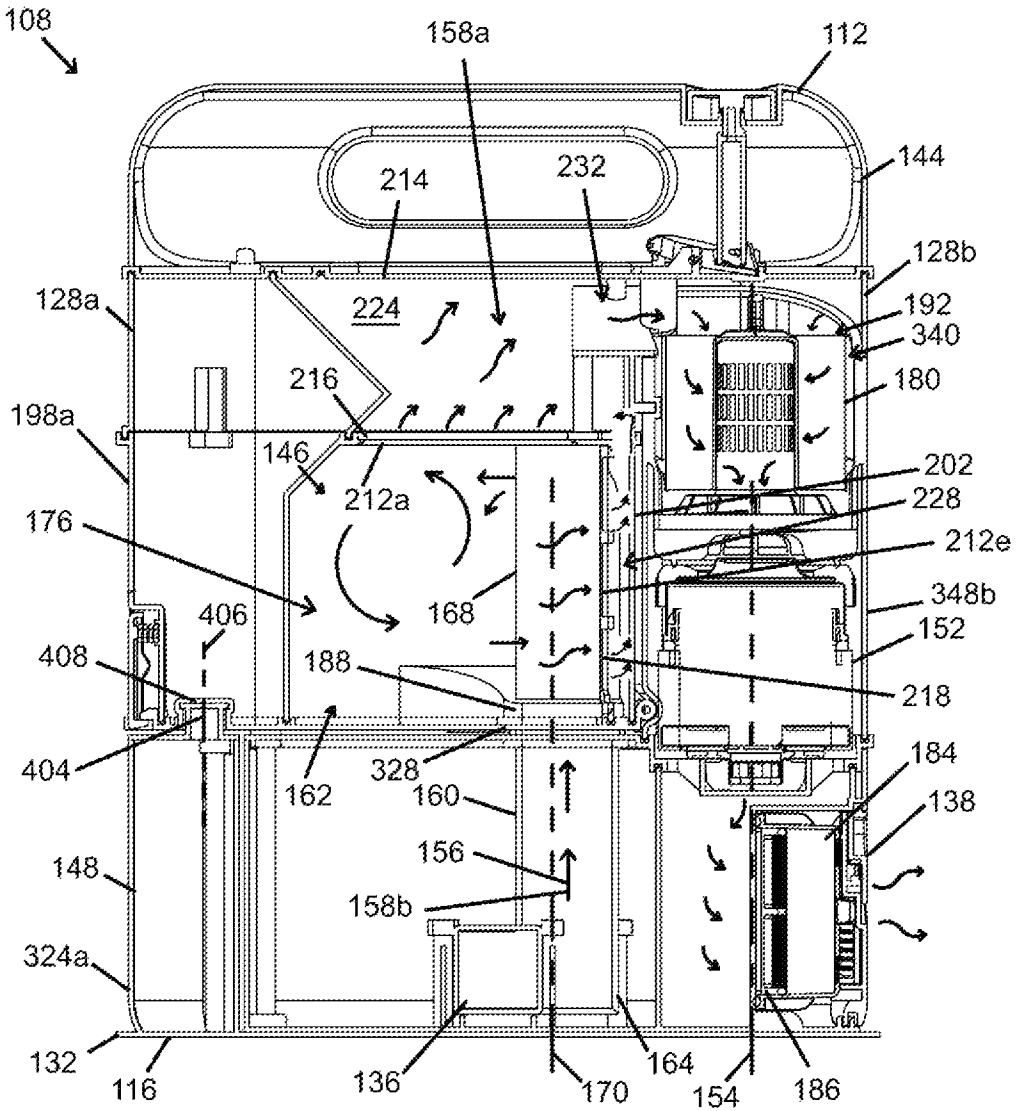
FIG. 2A is a cross-sectional view of the evacuation station of FIG. 1A, taken along the section line 2-2' of FIG. 1A.
Figure 2B:
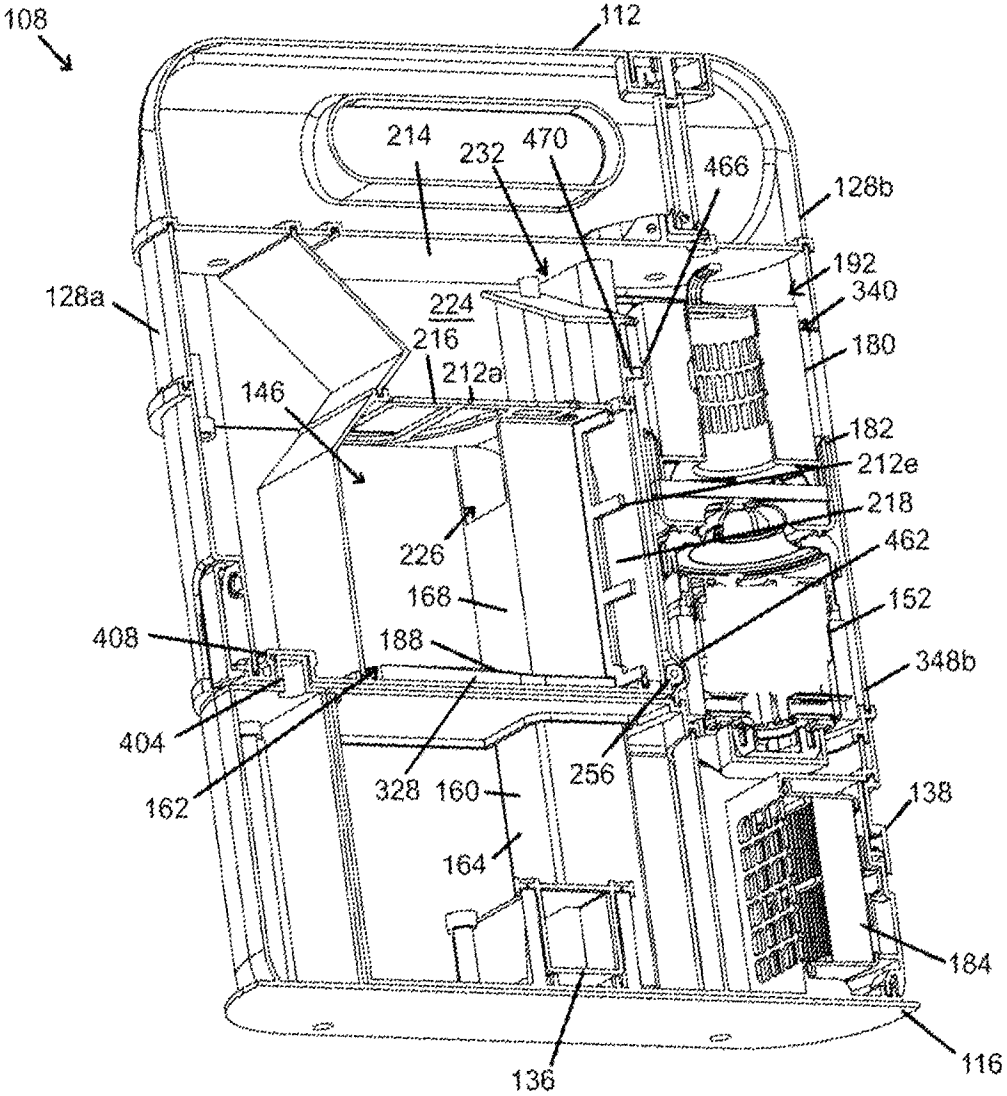
FIG. 2B is a perspective cross-sectional view of the evacuation station of FIG. 1A, taken along the section line 2-2' of FIG. 1A.

Referring now to FIGS. 2A and 2B, the evacuation station 108 can include a suction device 152 to provide the suction force of air used for emptying a docked robot 104 (i.e., airflow 156 in FIG. 2A).

Suction device 152 may be user-activated (e.g., via an activation mechanism located on the evacuation station 108), remotely/wirelessly activated, or otherwise automatically activated upon the robotic vacuum 104 docking. In some embodiments, the evacuation station 108 may be plugged into a power outlet which powers the suction device 152. In other cases, the evacuation station 108 can include an on-board energy storage system (e.g., one or more batteries) (not shown) for powering the suction device 152.

As exemplified, an air treatment member 146 is positioned in the airflow path 156 and can comprise one or more separating stages for separating air entrained dirt and debris from the airflow 156 during operation of suction device 152.

In particular, airflow 156 entering the station air inlet 136, may flow downstream through an inlet conduit 160 (e.g., extending along a conduit axis 170), and may exit into the air treatment member 146 via an air treatment member inlet 226. Air treatment member 146 may receive the airflow and may operate to separate air-entrained dirt and debris from the airflow 156 such that at least partially cleaned air may exit the air treatment member 146. In various cases, disentrained dirt may collect and aggregate inside a dirt collection region 162 of the air treatment member 146 (FIGS. 2A-2B), or otherwise inside an external dirt collection chamber 162 (FIG. 24).

Air treatment member 146 may comprise any suitable dirt separating mechanism for separating air-entrained dirt.

Figure 24A:
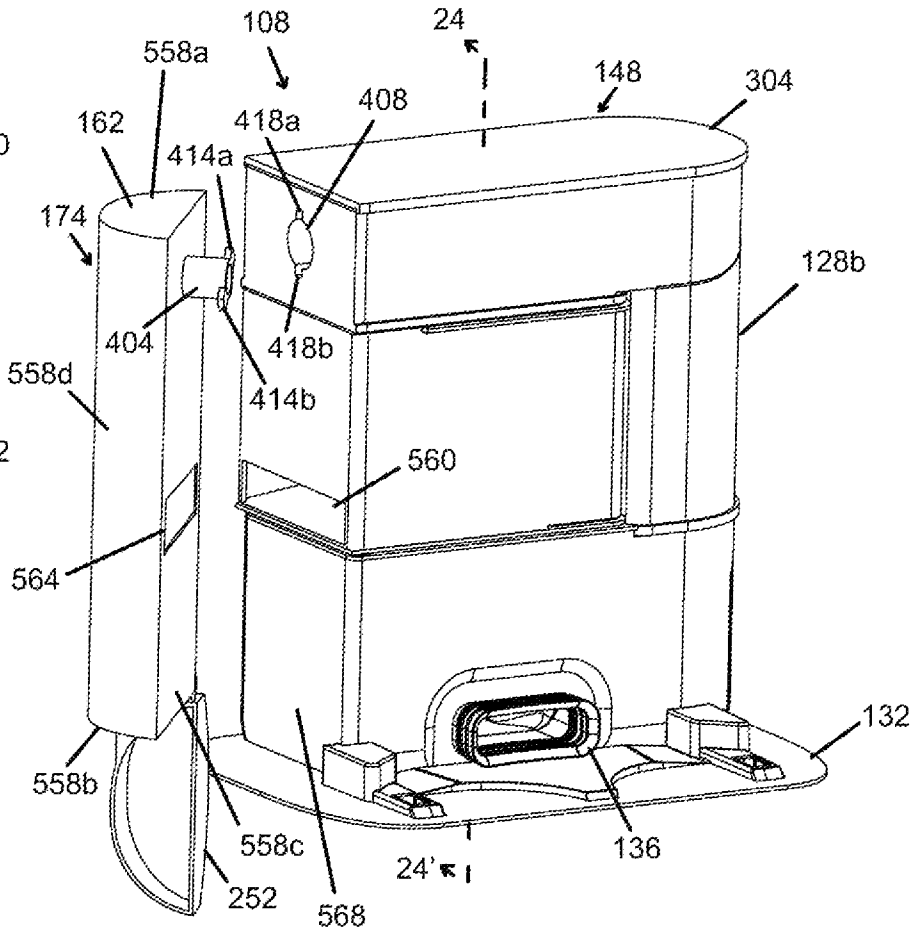
FIG. 24A is a front perspective view of another example embodiment of an evacuation station having a removable external dirt container, and showing the external dirt container in a removed position.
Figure 24B:
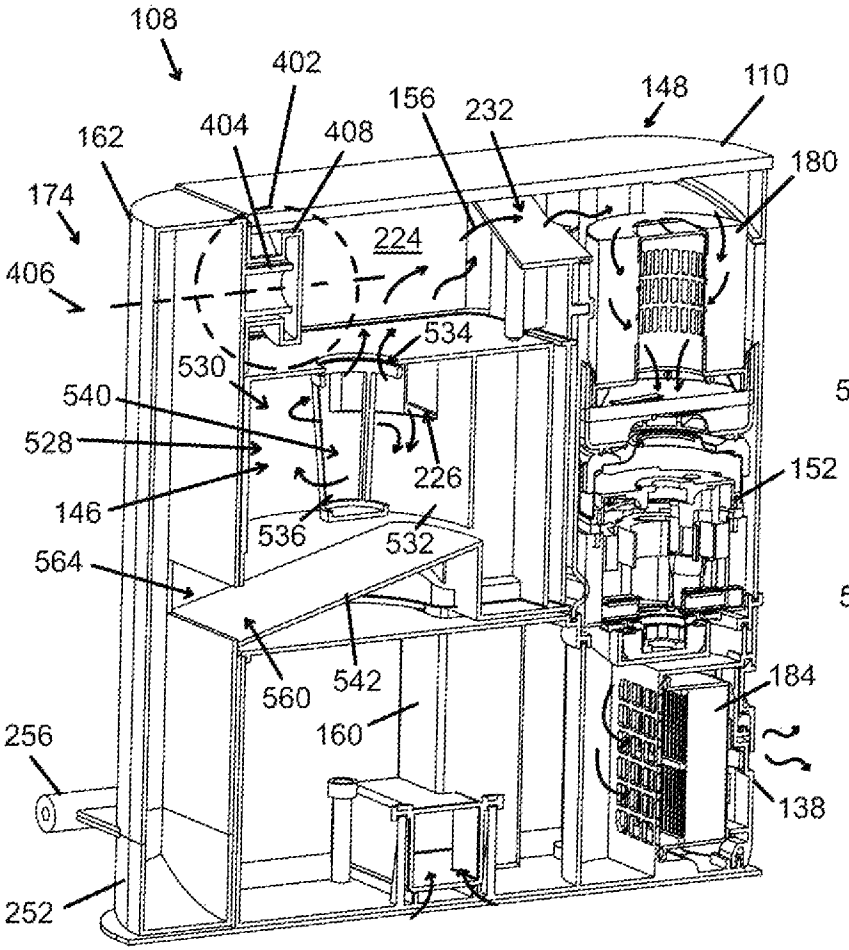
FIG. 24B is a cross-sectional view of the evacuation station of FIG. 24A, taken along the section line 24-24' of FIG. 24A, and showing the external dirt container in a mounted position.

For example, FIGS. 2-5 exemplify an air treatment member 146 comprising a single-stage momentum separator 204. FIGS. 24A-24B exemplify an alternative single-stage cyclone separator 530. In other embodiments, the air treatment member 146 can comprise a multi-stage separator which includes, for example, a first stage momentum separator, and a second stage cyclone separator, or vice-versa.

Figure 5:
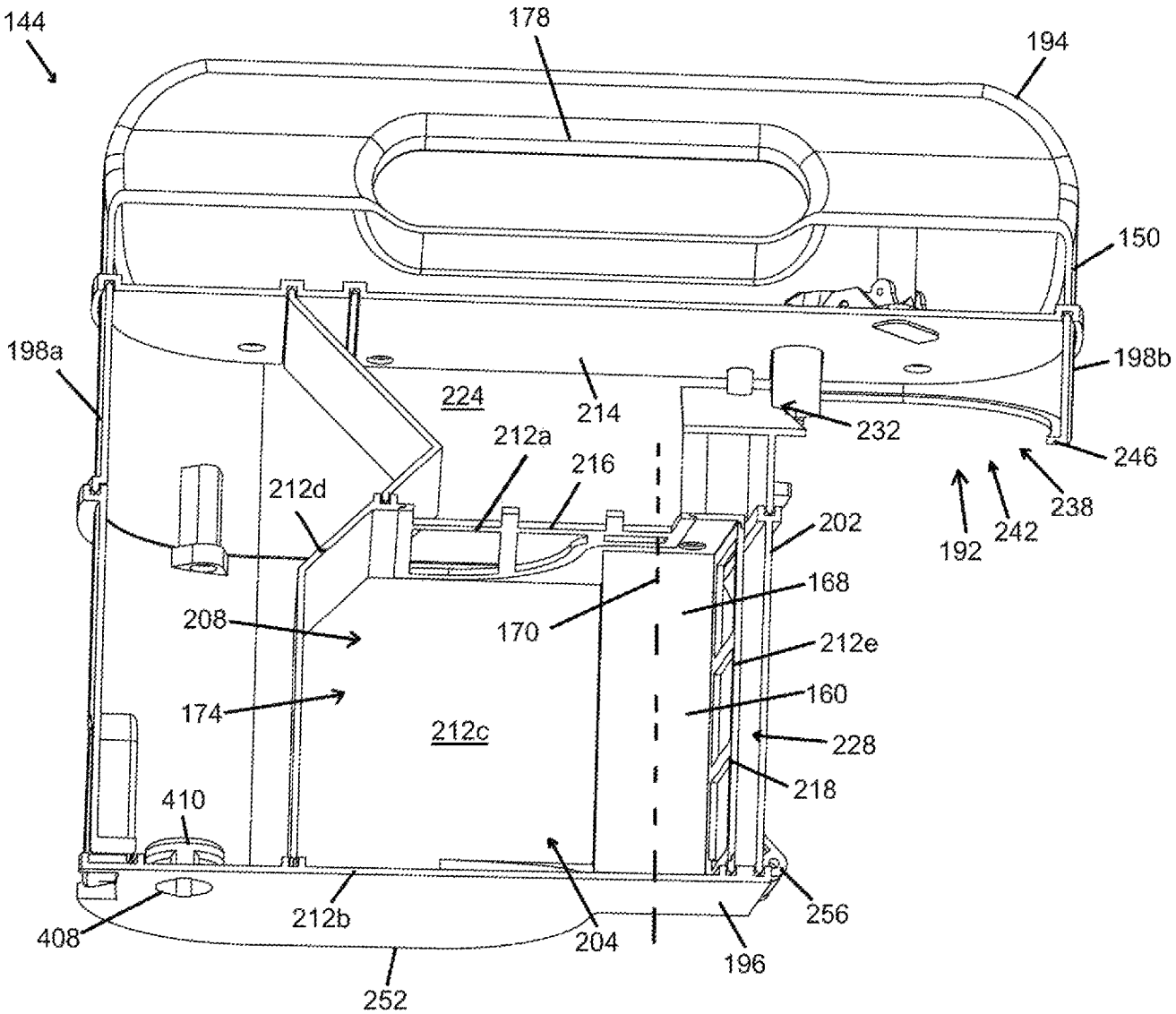
FIG. 5 is a perspective cross-sectional view of the air treatment assembly, taken along the section line 5-5' of FIG. 3.

As exemplified in FIG. 5—the momentum separator 204 can include a momentum separator chamber 208 bounded by an upper wall 212*a,* a lower wall 212*b,* front/rear walls 212*c* and opposed lateral walls 212*d,* 212*e*. In some cases, one or more of the momentum separator walls may form part of the evacuation station body 110 (e.g., lower wall 212*b*).

One or more walls of the momentum separator chamber 208 may also comprise porous walls, e.g., part or all of one or more of the walls may be partially or fully porous. The porous walls, or porous section of walls, are configured to have openings and to be generally air permeable such that air may exit the momentum separator 204 by flowing outwardly through the openings in the porous walls or porous wall sections. The porous walls or porous wall sections may comprise, for example, a screen, a mesh, a net, a shroud, or any other air permeable medium that is configured to pass air flow, while separating (or filtering) the air flow from dirt and other solid debris. The openings in the porous walls may be selected to inhibit dirt of a predetermined size from exiting the momentum separator.

In some embodiments, the porous wall sections may comprise a majority of a wall (a porous wall). For example, the porous portion of a wall may have a surface area that is between 40-100%, 50-100%, 60-100%, 70-100%, 80-100% or 90-100%, or anywhere in between, of the total surface area of the porous wall having the porous portion.

The momentum separator 204 may include any number of porous walls, or walls which include porous sections. For instance, as best exemplified in FIG. 5, the upper wall 212*a* and the lateral sidewall 212*e* may each comprise portion sections defined by screens 216, 218, respectively, that are generally air permeable. Accordingly, as shown in FIGS. 2A and 2B, air can exit the momentum separator 204 by flowing upwardly and outwardly through the top screen 216, or laterally through the side screen 218 and then upwardly.

Each of the momentum separator's upper and lateral porous walls 212*a*, 212*e* can be inwardly spaced (e.g., inset) from the station body 110 such as to define an up-flow chamber 224 and a side-flow chamber 228, respectively (FIGS. 2A and 2B).

For example, the momentum separator top screen 216 may be axially spaced, e.g., along conduit axis 170, from an inner upper wall 214 of the station body 110, such as to define the up-flow chamber 224. Accordingly, the up-flow chamber 224 is positioned to receive air that flows upwardly and outwardly from the separator 204 (FIG. 2A).

Similarly, the side screen 218 of the momentum separator 204 may be inset from an end wall 202 of the station housing 110, such as to define the side-flow chamber 228. Accordingly, the side-flow chamber 228 is positioned to receive airflow exiting the momentum separator 204 laterally (FIG. 2A). As exemplified, the up-flow and side-flow chambers 224, 228 may be in fluid communication with each other.

In the exemplified embodiments, a lower portion of the momentum separator chamber 208 may define a dirt collection region 162. In particular, dirt particles, which do not pass through the screens 216, 218, may collect in the dirt collection region 162, or otherwise on the lower wall 212*b* of the momentum separator chamber 208. In other embodiments, exemplified in FIG. 24, the dirt collection region 162 may be a discrete volume from the air treatment member 146, or located partially externally of the volume of the air treatment member 146.

Alternately, or in addition, as exemplified in FIGS. 24A-24B, the air treatment member 146 may comprise a cyclone separator 530. As exemplified, the cyclone separator 530 can comprise a cyclone chamber 528 having a cyclone sidewall 532. Air may enter into the cyclone chamber 528 via a cyclone air inlet 226 (e.g., a tangential air inlet 226 on the sidewall 532) and may exit through a cyclone air outlet 534.

As shown, cyclone air inlet 226 may direct the dirty air flow to enter cyclone chamber 176 in a tangential direction so as to promote cyclonic action. Dirt particles and other debris may be dis-entrained (i.e. separated) from the dirty air flow as the dirty air flow travels through cyclone chamber 528. Optionally, as exemplified, dis-entrained dirt may be ejected from the cyclone chamber 528, into an external dirt collection chamber 162, via a dirt outlet 560. In some embodiments, a lower surface 542 of the cyclone chamber 528 may have a downwardly slanted design to assist in ejecting dirt into the external dirt chamber 162. In other embodiments, the dirt collection chamber 162 may not be a discrete volume but may comprise a lower portion of the cyclone chamber 528.

Air exiting the cyclone chamber 528 may pass through an outlet passage 540 located upstream of the cyclone air outlet 534. Cyclone chamber outlet passage 540 may also act as a vortex finder to promote cyclonic flow within cyclone chamber 540. In some embodiments, cyclone outlet passage 540 may include a porous member, such as a screen or shroud 536 (e.g. a fine mesh screen) in the air flow path 156 to remove large dirt particles and debris, such as hair, remaining in the exiting air flow. The screen or shroud 212 may have any configurations known in the art.

Referring now back to FIGS. 2A-2B, air exiting the air treatment member 146 may continue downstream, through an air outlet port 232. In the exemplified embodiment, air outlet port 232 is formed between the housing end wall 202 and the housing inner upper wall 214.

Optionally, one or more of a pre-motor filter 180 and a post-motor filter 184 are located inside the evacuation station 108, along the airflow path 156. For instance, as exemplified, the pre-motor filter 180 may be located downstream of the air treatment member 146 and upstream of the suction device 152, while the post-motor filter 184 may be located downstream of the suction device 152.

Optionally, as exemplified, the pre-motor filter 180, suction motor 152 and post-motor filter 184 may be vertically stacked, such that the suction device 152 is positioned generally below the pre-motor filter 180 and above the post-motor filter 184. In this configuration, the motor axis of rotation 154 generally intersects each of the pre-motor filter 180 and post-motor filter 184. In other embodiments, the filters 180, 184 may be arranged in any other suitable arrangement relative to the suction motor 152.

Pre-motor filter 180 may receive airflow exiting the air treatment member 146, and may function to remove particles of dirt and debris from air exiting the air treatment member 146 (i.e., particles not removed by the air treatment member 146), prior to passing through the suction device 152.

Figure 11C:
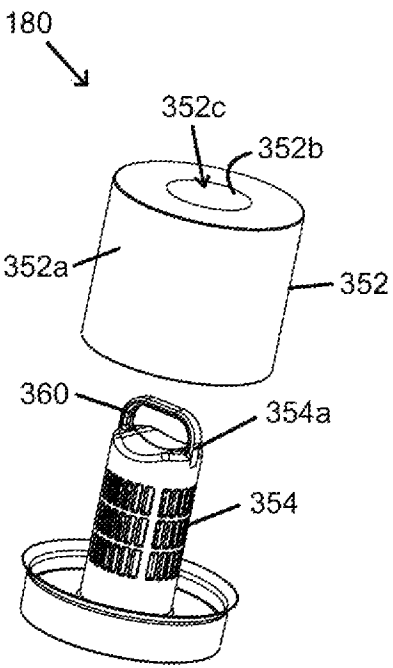
FIG. 11C is a partial exploded perspective view of the pre-motor filter.

The pre-motor filter 180 may be made of any filter media known in the art and may be a foam filter. For instance—as best exemplified by FIGS. 11A-11C—the pre-motor filter 180 can be a "donut filter" which comprises an air permeable annular foam exterior 352 removably placed, or otherwise wrapping around (e.g., surrounding) a grill portion 354 having one or more perforations for air to pass through. The foam portion 352 may be removable from the grill portion 354 for cleaning and/or periodical replacement (FIG. 11C).

As exemplified in FIGS. 2 and 11, during operation of the evacuation station 108, airflow 156 can pass through the foam portion 352, e.g., from a radial outer surface 352*a* to a radially inner surface 352*b*. The foam portion 352 can, in turn, separate dirt and debris from the airflow. Airflow 156 can then pass may then continue through the grill portion 354—disposed inside an inner annular gap 352*c* of the foam portion—and downstream to the suction device 152.

In some embodiments, a post-motor filter 184 may also be provided for further dis-entraining dirt and debris from the airflow 156, and may also be formed from any suitable filter media (e.g., a foam filter, a felt filter, HEPA filter, or any other physical filter media).

Description of a Removable Portion of the Evacuation Station

The following is a discussion of a removable portion of the evacuation station 108, which can be removed to facilitate cleaning and emptying of dirt collected inside the evacuation station 108. The removable portion can comprise or consist of, for example, an air treatment assembly 144 (FIGS. 3-23), which can include the air treatment member 146 and a dirt collection region 162. In other cases, the removable portion may comprise or consist of at least a dirt collection chamber 162 (i.e., an external and removable dirt collection chamber) of the evacuation station 108 (FIG. 24).

In exemplified embodiments, the removable portion of the evacuation station 108 is moveable (e.g., translatable vertically) between a mounted position and a removed position. In the mounted position, the removable portion is attached (e.g., mounted) to a stationary base portion of the station 108 (FIGS. 1A-1D, 24A). In this position, the removable portion is orientable to be in fluid communication with the stationary base such that the evacuation station 108 is operable. In the removed position, the removable portion is dis-mounted (e.g., lifted-away) from the stationary base portion. In various cases, this can allow a user to transport the removable portion elsewhere for emptying.

An advantage of the removable design configuration is that a user is not required to transport the entire evacuation station 108 each time the station is required to be emptied of dirt. Further, once the removable portion is dis-mounted, the user may be permitted access to one or more components inside the evacuation station 108 for cleaning and/or replacement (e.g., the pre-motor filter 180).

FIGS. 3-7 exemplify embodiments of a removable portion 172 comprising an air treatment assembly 144. It will be appreciated that only the air treatment assembly 144 may be removable. Alternately the air treatment assembly 144 may be a component of the removable portion 172. For example, the removable portion 172 may also include a handle, which may also function as a handle portion 178 of the docking station when the removable portion 172 is in the stationary base 148. Alternately or in addition, the removable portion may include one or more air flow passages.

Figure 3:
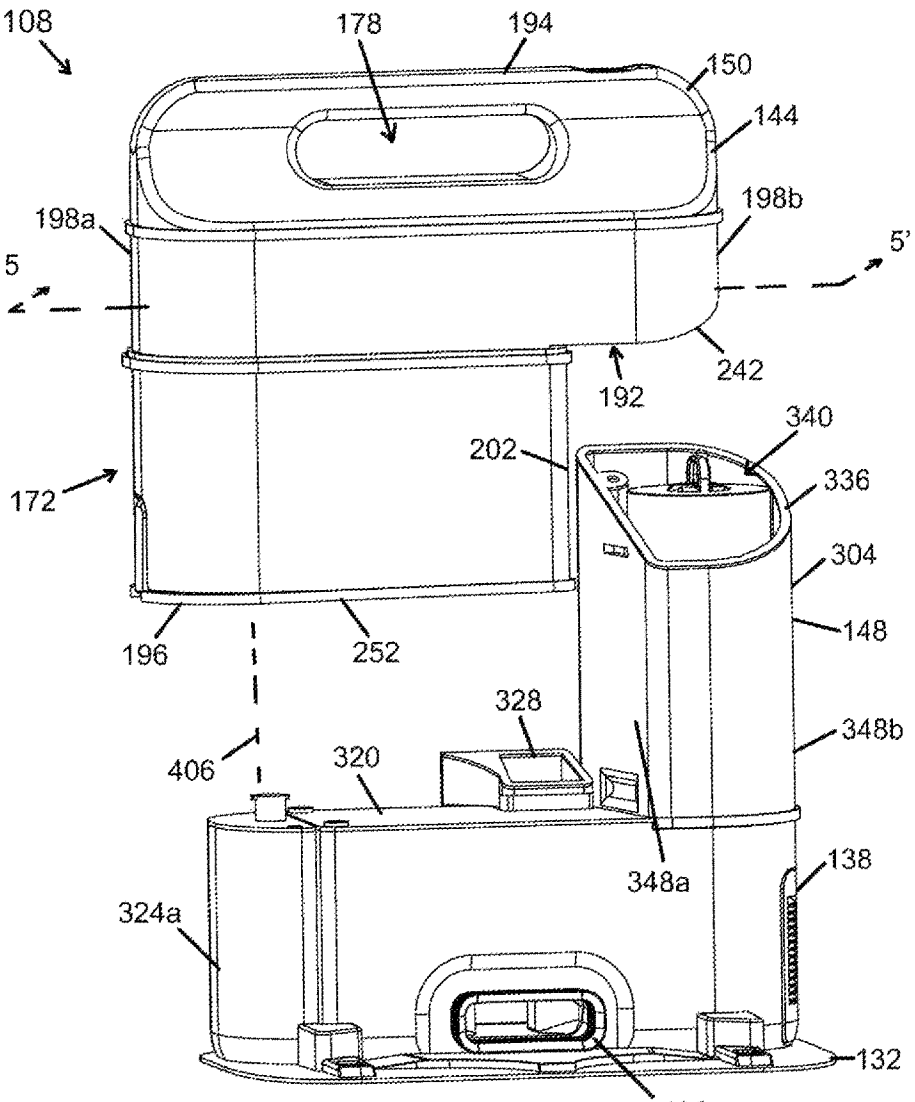
FIG. 3 is a partial exploded view of the evacuation station showing an air treatment assembly removed from a stationary base portion.

As exemplified in FIG. 3, the evacuation station 108 includes an air treatment assembly 144 that is removably mounted to a stationary base portion 148 between a mounted position (FIGS. 1A-1D), and a removed position (FIG. 3).

As best shown in FIG. 5, the removable assembly 144 comprises an assembly housing body 150 housing the air treatment member 146, as well as a dirt collection region 162. An upper conduit portion 168—of the evacuation station's inlet conduit 160—may also be disposed inside the housing 150. In other embodiments, the assembly housing 150 may house any number of other components of the evacuation station 108 including, for example, the pre-motor filter 180.

As exemplified in FIGS. 4-5, the assembly housing 150 includes an upper end 194, an opposed lower end 196 and lateral side-faces 198*a*, 198*b*. When the assembly 144 is mounted to the stationary base 148, the upper assembly end 194 defines an upper end 112 of the evacuation station 108 (FIG. 1B). Further, the assembly's lateral faces 198*a*, 198*b* define an upper end of the station's lateral faces 128*a*, 128*b*.

Assembly housing 150 also includes a front face 430*a* and an opposed rear face 430*b*, which also correspond to a portion the evacuation station's front and rear faces 120, 124 in the mounted position.

Optionally, an upper end 194 of the assembly housing 150 comprises a handle portion 178. Handle portion 178 can allow a user to remove (e.g., lift-away) the air treatment assembly 144 from the base 148, as well as to transport the assembly 144 (e.g., to an external dirt bin for emptying).

Figures 4A, 4B, 4C:
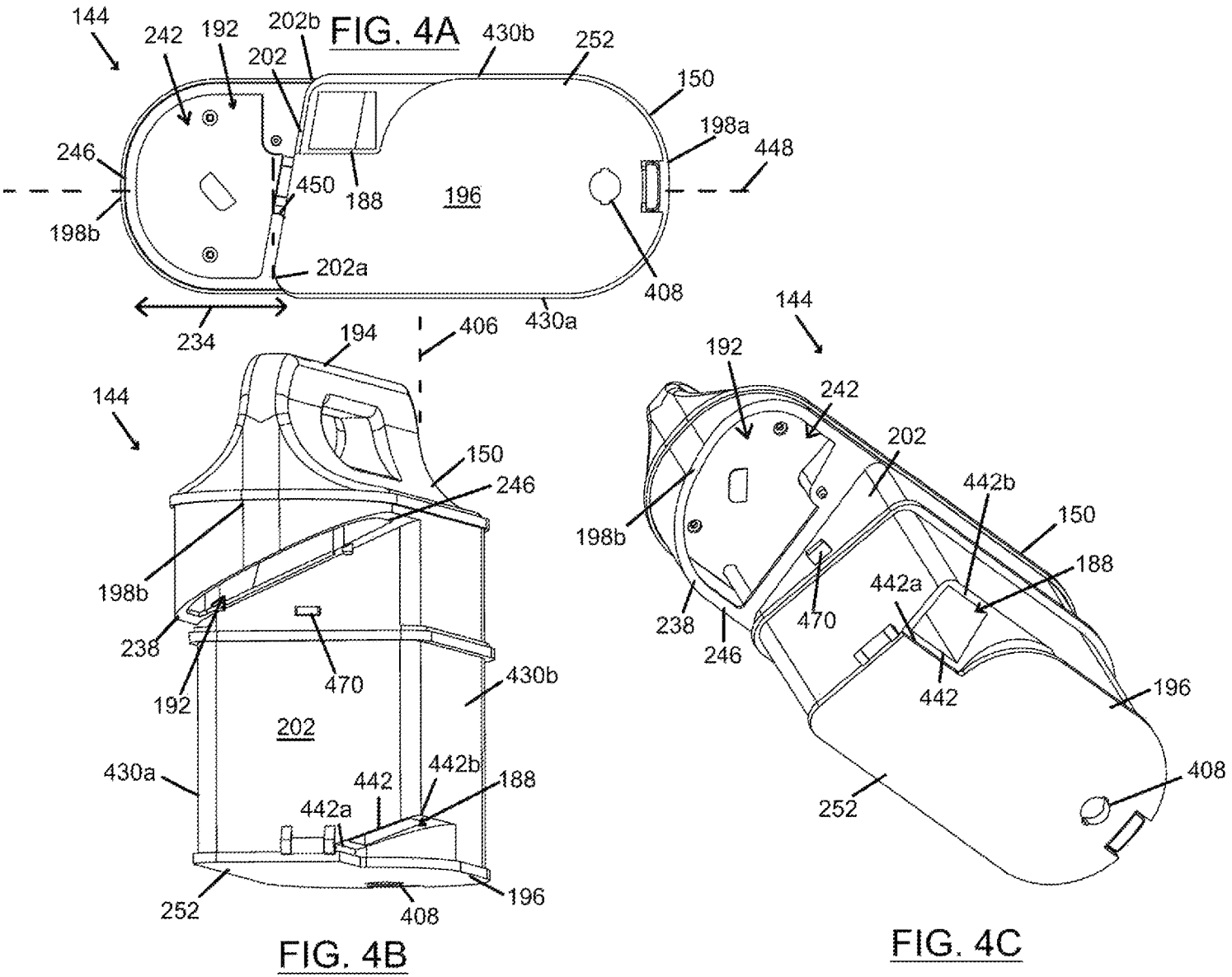
FIG. 4A is a bottom plan view of the air treatment assembly.
FIG. 4B is a side perspective view of the air treatment assembly.
FIG. 4C is a bottom-up perspective view of the air treatment assembly.

As exemplified in FIGS. 4A-4C, the assembly housing 150 can also include an assembly air inlet 188, and an assembly air outlet 192.

In the mounted position (FIG. 1)—the air inlet 188 interfaces with the base 148 to receive a stream of dirt entrained air (e.g., travelling along airflow path 156) when the evacuation station 108 is operated (FIG. 2). In particular, air entering the assembly 144, via inlet 188, may travel through the upper inlet conduit 168 before passing through the air treatment member 146, and exiting through the assembly air outlet 192. In the mounted position, the assembly's air outlet 192 is positioned to communicate with the base 148 such that exiting air flows back into the base 148. In various cases, the segment of the airflow path 156—between air inlet 188 and air outlet 192—defines an "air treatment assembly airflow path portion" 158*a* (FIG. 2A).

Air inlet 188 and air outlet 192 may be located at any suitable position around the assembly housing 150 to interface with the stationary base 148 in the mounted position.

Figure 8:
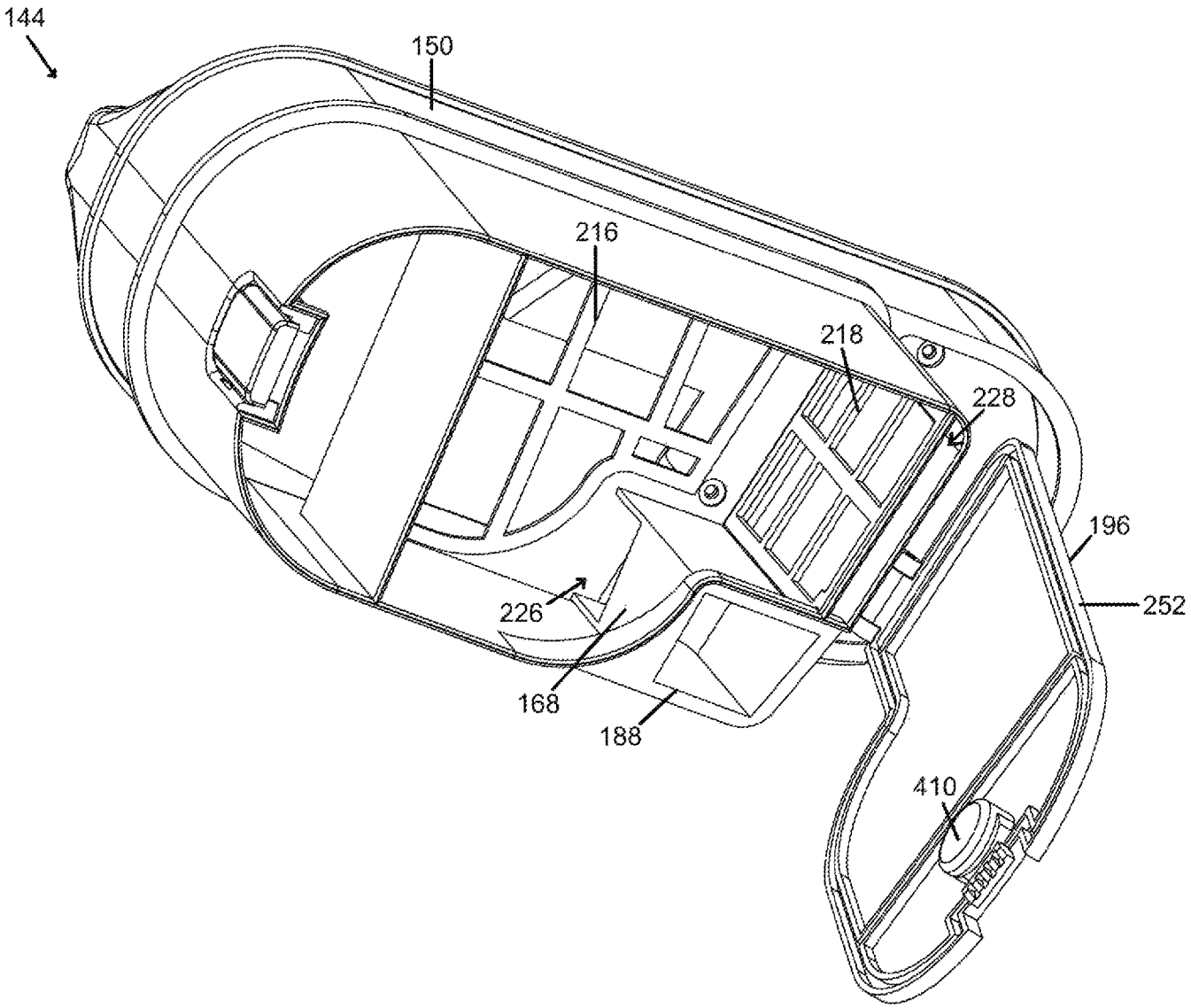
FIG. 8 is a bottom-up perspective view of the air treatment assembly with a bottom openable door in the open position.

For example—as exemplified in FIGS. 4A-4C—air inlet 188 may be located at a lower end 196 of the assembly housing 150 (FIG. 8). In this position, when the assembly is in the mounted position (FIG. 2), the upper inlet conduit 168 interfaces with the lower inlet conduit 164, via the air inlet 188 (i.e., along conduit axis 170).

As further exemplified, the assembly air outlet 192 may be located at an upper portion of the assembly housing 150 (FIGS. 4A-4C). For example, the air outlet 192 may comprise a down-ward facing opening 242 formed between the housing sidewall 198*b* and a recessed end wall 202 (i.e., forming an overhanging portion 238). For example, as exemplified in FIG. 4A, the end wall 202 may be recessed by a lateral distance 234 from the sidewa11198*b*, along a lateral axis 448.

Preferably, the bottom wall 196, of the assembly housing 150, comprises an openable door 252. In the removed position, the openable door 252 may be opened to empty the contents of the dirt collection region 162. As exemplified in FIG. 8, opening the door 252 can also provide access to the momentum separator screens 216, 218, e.g., for cleaning or replacing. Still further, opening door 252 can facilitate access to emptying and/or cleaning the side-flow chamber 228, as well as the upper conduit 168.

As exemplified, the openable door 252 may move (e.g., rotate or translate) between a closed position (FIG. 7A) and an open position (FIG. 7B) in any manner known in the art. For instance, FIGS. 7A and 7B exemplify one embodiment where the door 252 is rotatably mounted to the assembly body 150 by a hinge 256. In particular, the hinge 256 may mount door 252, for example, to the assembly end wall 202. As exemplified, hinge 256 rotates along rotation axis 260 to rotate the door between the open and closed positions.

In other embodiments, the openable door may not be located on the lower side of assembly 144 but may be provided at any other suitable location around the assembly body 150. In some cases, more than one openable door may be provided. For example, a top openable door may also be provided (e.g., along an upper end 194 of the assembly body 150) to provide access to the up-flow chamber 224 and/or top screen 216.

Optionally, the air treatment assembly 144 includes a door locking mechanism to hold the door 252 in the closed position (FIG. 7A).

In the exemplified embodiment, the door locking mechanism comprises a releasable latch mechanism 264 that secures the door 252 in the closed position. For example, the latch mechanism 264 may be located along the side face 198*a* of the assembly housing 150 (FIGS. 6A-6C).

As exemplified, the latch mechanism 264 can include a release member 268 (e.g., a depressible button), having an upper portion 268*a* and a lower portion 268*b*. The upper portion 268*a* is pivotally mounted to the assembly body 150 and is rotatable between the locked position (FIG. 6C) and unlocked position (FIG. 6B).

In the locked position, the lower member portion 268*b* can comprise a hook which engages a latch 272 of the door 252 so as to secure door 252 in the closed position. In the unlocked position, the release member 268 is rotated away to disengage hook 268*b* from the door latch 272 and release the door 252 in the open position.

Figures 6A, 6B, 6C:
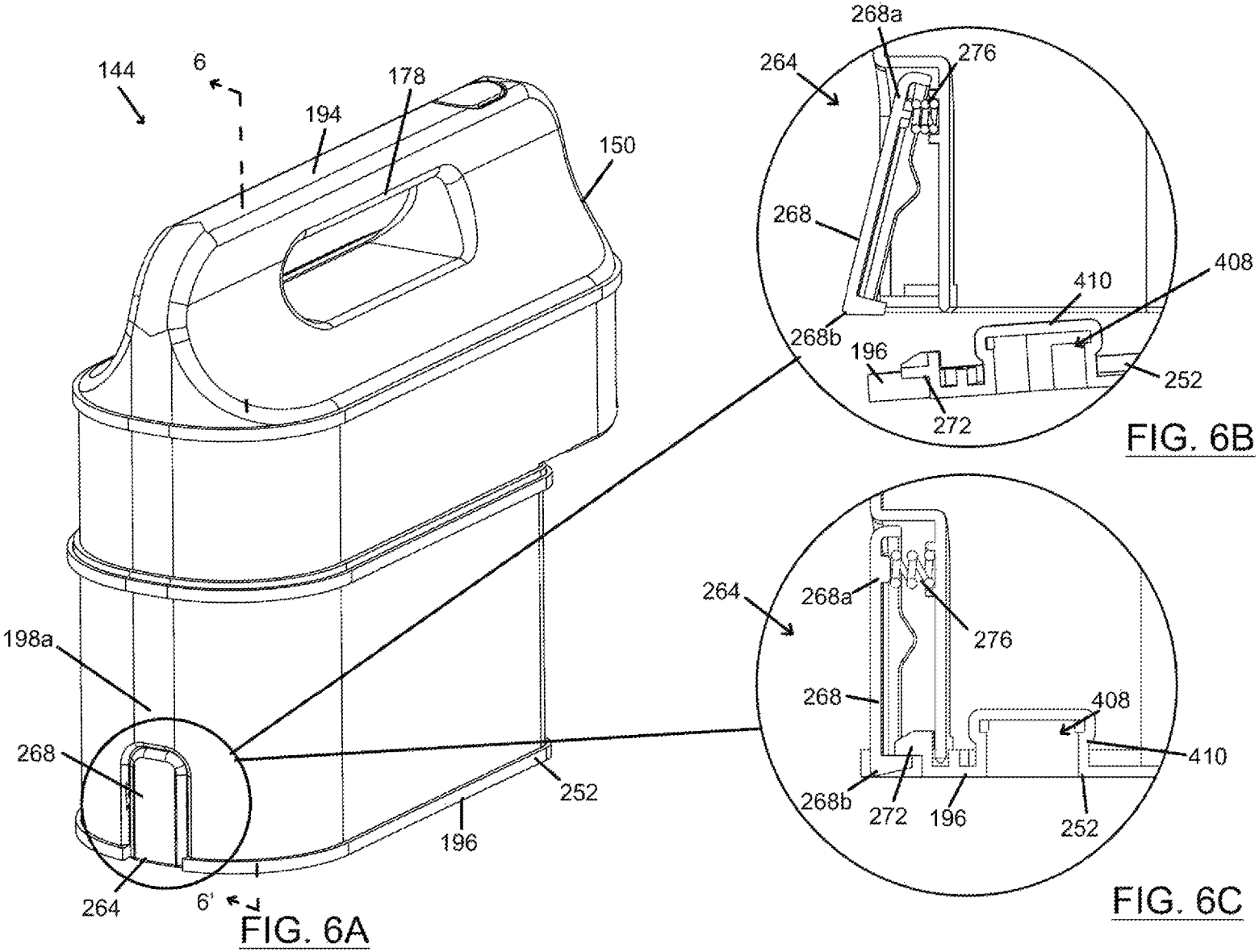
FIG. 6A is a front-side perspective view of the air treatment assembly.
FIG. 6B is a close-up cross-sectional view, taken along the section line 6-6' of FIG. 6A, of a door locking mechanism for the air treatment assembly, and showing the door locking mechanism in an unlocked position.
FIG. 6C is the cross-sectional view of FIG. 6B, and showing the door locking mechanism in a locked position.

Optionally, a biasing spring 276 biases the release member 268 in the locked position (FIG. 6C). For example, the biasing spring 276 may be biased to the expanded position to rotate the release member 268 in the locked position. The biasing spring 276 may be positioned, for example, between the assembly housing 150 and the upper portion 268*a* of release member 268.

As exemplified in FIGS. 24A-24B, the removable portion 172 may comprise only an external dirt container 162.

As exemplified in these figures, the stationary base portion 148 may now house a majority of components of the evacuation station 108 (e.g., including the air treatment member 146), with the removable portion 172 comprising only the removable dirt chamber (or container) 162.

As shown, the removable dirt container 162 may include a dirt container housing 558 having a hollow interior (i.e., for collecting and aggregating dirt), as well as a top end 558*a*, bottom end 558*b*, and lateral sides 558*c*, 558*d*. An opening defining the dirt inlet 564 is optionally provided on a lateral face 558*c* of the container housing 558 but can also be located at other locations around housing 558.

The removable container 162 may move (e.g., translate) between a mounted position (FIG. 24B) and a removed position (FIG. 24A), relative to the base 148. In the mounted position (FIG. 24B), the dirt inlet 564 of the container 162 interfaces, and is in fluid communication, with a dirt outlet 560 of the air treatment member 146, to receive dis-entrained dirt during operation of evacuation station 108.

Optionally, the lower end 558*b* of the dirt container housing 558 may define a bottom openable door 252, which is moveable between a closed position (FIG. 24B) and an open position (FIG. 24A) in a manner analogous to the door 252 previously exemplified in FIGS. 7A and 7B (e.g., via a hinge 256).

While the exemplified embodiments illustrate only a single removable portion 172, it will be appreciated that the removable portion 172 may be of any size, shape and configuration which contains one or more dirt collection regions and that the dirt collection region may collect dirt from any type of air treatment assembly. Further, any number of removable portions 172 may be provided in the evacuation station 108. For example, the evacuation station 108 may include an air treatment member 146 with multiple separating stages, each separating stage having its own dirt collection area. Accordingly, in this case, multiple removable portions may be provided corresponding to each separating stage and corresponding dirt collection region. In other cases, the multiple removable portions can correspond to separate external dirt collection containers, corresponding to one or more separating stages of the air treatment member.

General Description of a Stationary Base Portion of the Evacuation Station

The following is a discussion of a stationary portion of the evacuation station 108, also referred to herein as an evacuation station base portion 148 or base portion or stationary base portion. The evacuation station base portion 148 is provided as a mounting platform for receiving the removable portion 172 in the mounted position. The stationary base 148 may house any of the components of the evacuation station 108 that are not housed in the removable portion 172. It will be appreciated that the evacuation station base portion 148 may be of any size, shape and configuration and may house one or more of a suction motor, a pre-motor filter, a post-motor filer, an air treatment member or the like.

FIGS. 9-11 exemplify an embodiment of the stationary base portion 148 wherein the removable portion 172 comprises an air treatment assembly 144. As exemplified, the stationary base portion 148 may include a housing body 304 comprising the evacuation station air inlet 136 and the evacuation station air outlet 138, the suction device 152 and one or more filters (e.g., pre-motor filter 180 and post motor filter 184).

The base housing 304 may have any suitable design and, as exemplified, may be generally shaped to correspond (e.g., complement) the shape of the air treatment assembly 144. This, in turn, may allow for a fitting engagement between the assembly portion 144, and the stationary base portion 148, in the mounted position so as to form the evacuation station 108.

In the exemplified embodiments (FIGS. 10A and 10B), the housing body 304 can comprise two adjacent sections: a platform mounting section 308, and a filter and motor housing section 312. It will be appreciated that in other embodiments, the filters and motor may be provided in the platform mounting section 308 and, accordingly, a filter and motor housing section 312 may not be provided. Accordingly, for example, the upper extent of the housing body may be the upper surface of the platform mounting section 308.

Platform mounting section 308 provides a platform for receiving (e.g., supporting) the air treatment assembly 144 in the mounted position.

Figure 10B:
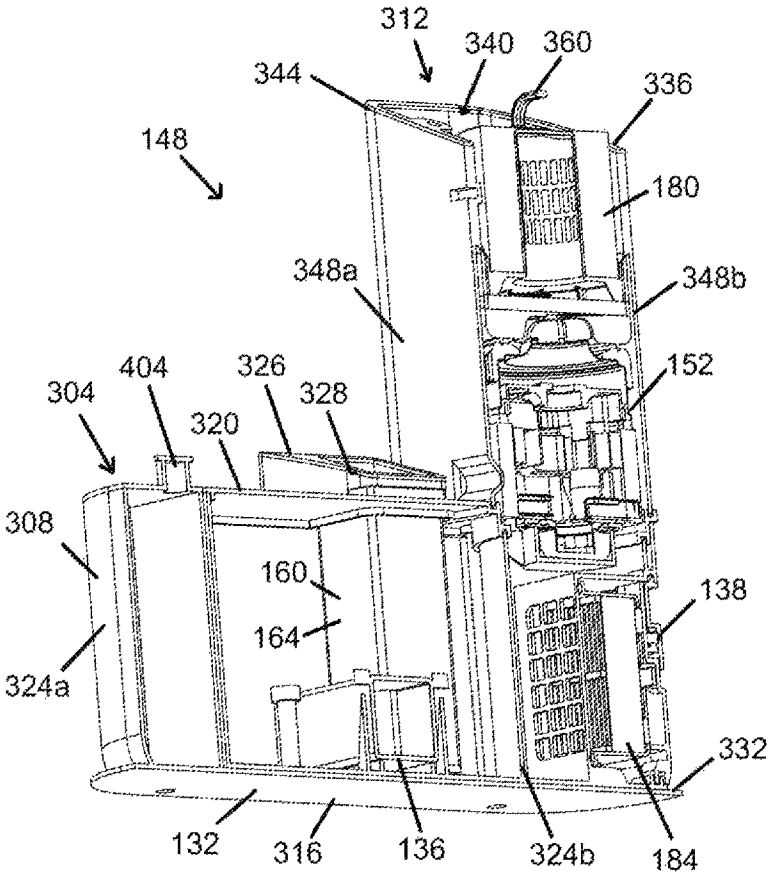
FIG. 10B is a perspective cross-sectional view of the stationary base portion, taken along the section line 10-10' of FIG. 9B.
Figure 10A:
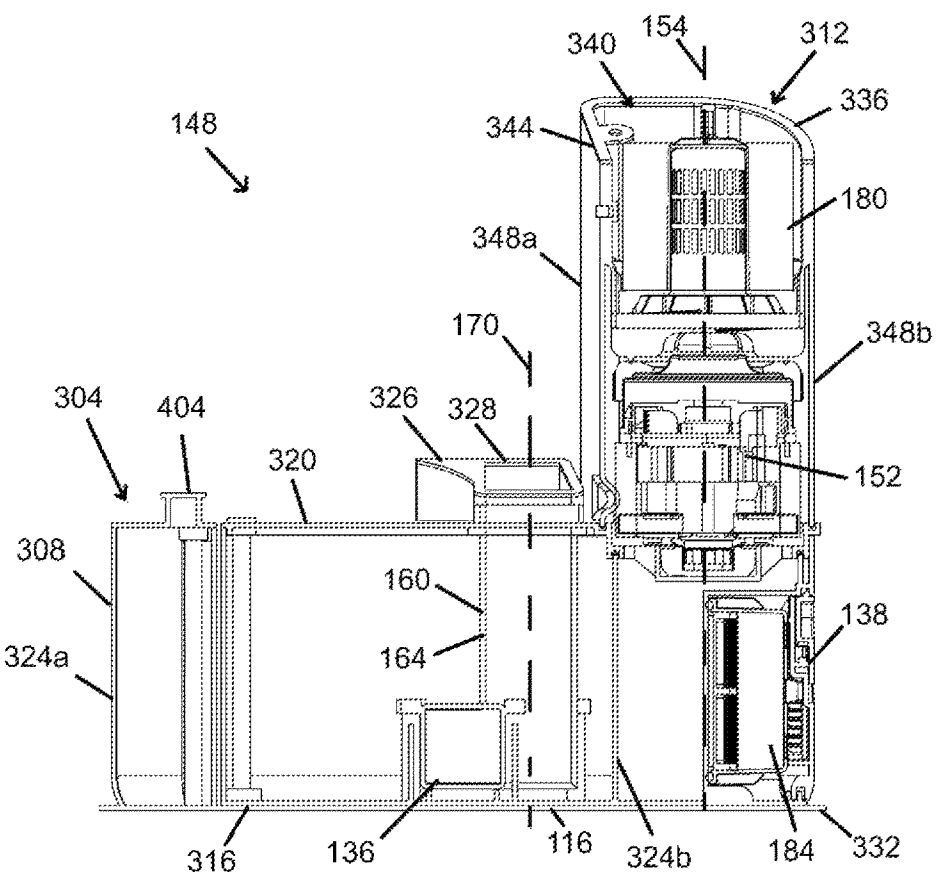
FIG. 10A is a cross-sectional view of the stationary base portion, taken along the section line 10-10' of FIG. 9B.

As best exemplified in FIGS. 10A and 10B, platform section 308 generally extends between a lower end 316, an opposed upper end 320, an outward-facing side face 324*a*, and an inward-facing side surface 324*b*. The inward-facing face 324*b* may abut the adjacent filter and motor housing 312.

Figure 1D:
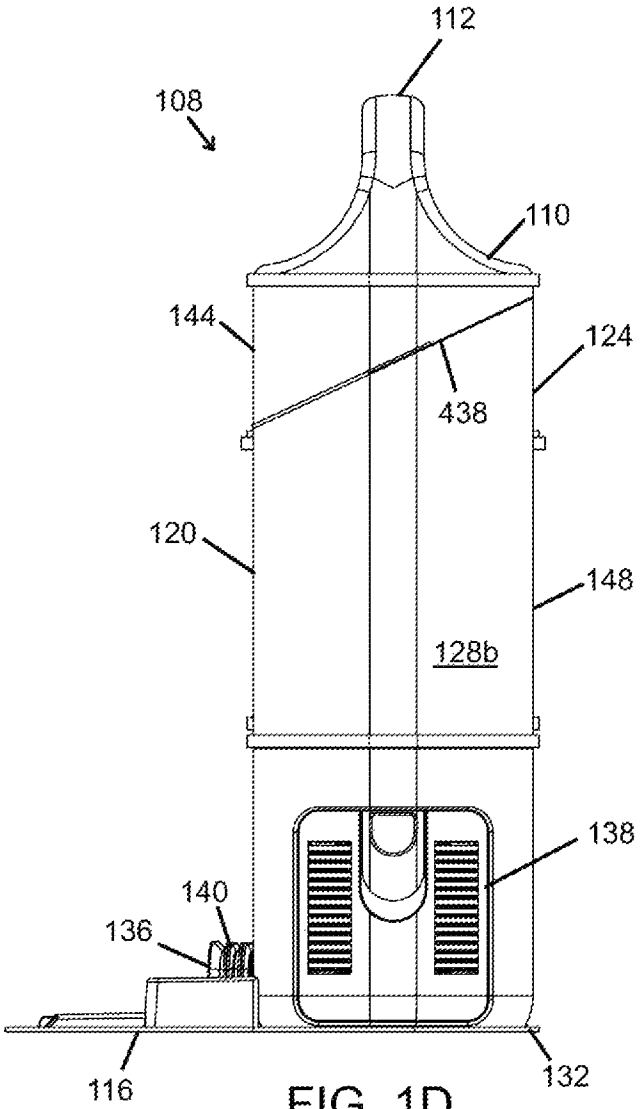
FIG. 1D is a side elevation view of the evacuation station.
Figure 1C:
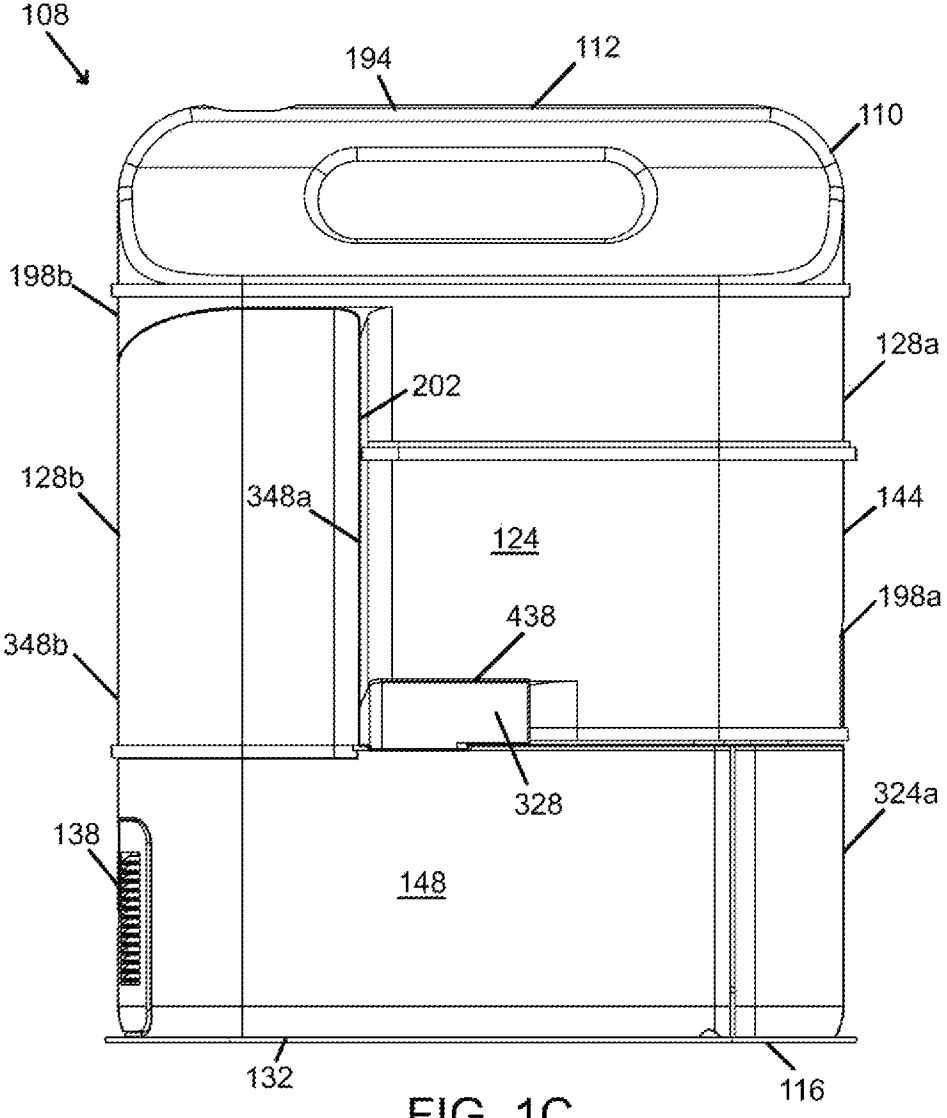
FIG. 1C is a rear elevation view of the evacuation station.
Figure 9A:
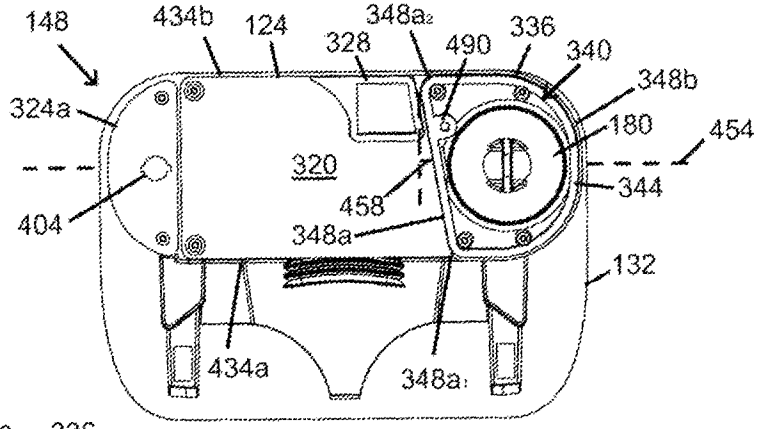
FIG. 9A is a top plan view of a stationary base portion of the evacuation station.
Figure 9D:
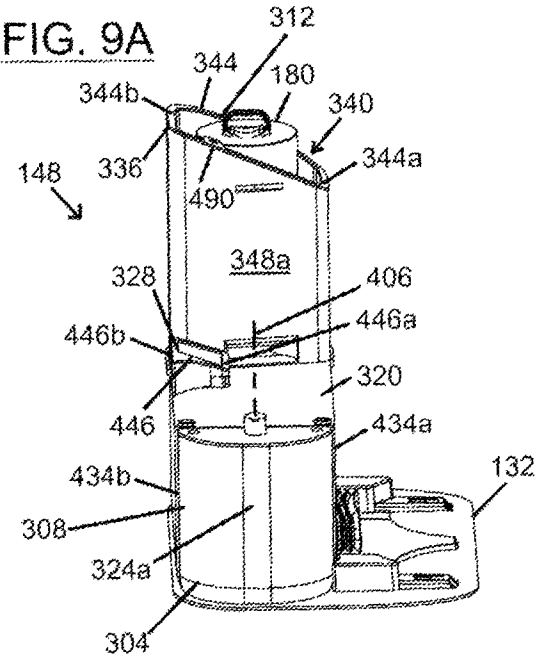
FIG. 9D is a side elevation view of the stationary base portion.
Figure 9C:
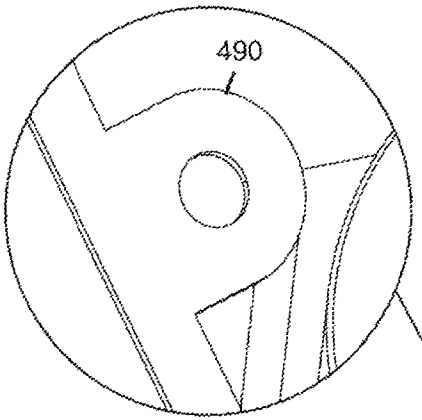
FIG. 9C is a close-up view of a portion of the stationary base portion, and showing a locking hole for removably receiving the locking pin of FIG. 7C.
Figure 9B:
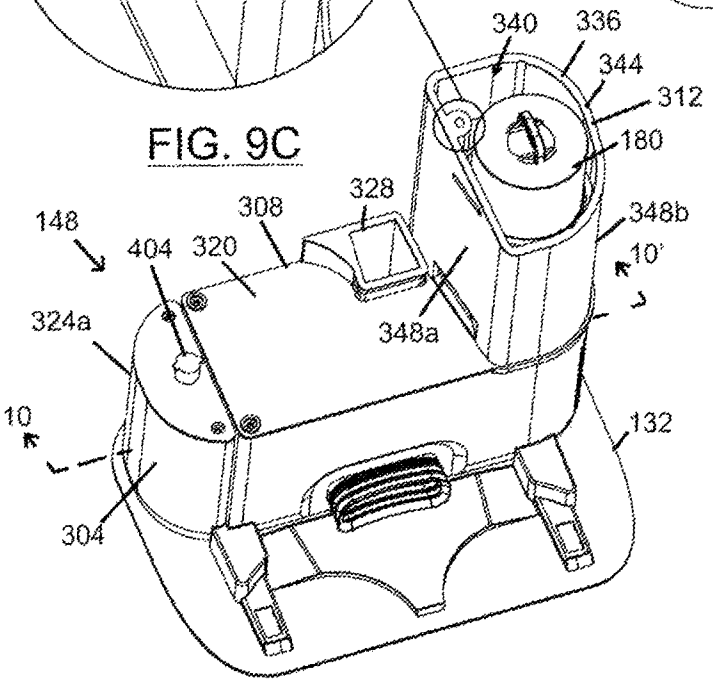
FIG. 9B is a top-forward perspective view of the stationary base portion.

As exemplified, the upper platform surface 320 may be generally planar to complement the planar design of the assembly's lower end 196 (FIGS. 9A and 9B). Preferably, the upper platform surface 320 may also extend laterally—along a longitudinal axis 454 (FIG. 9A)—a substantially equal distance to the lateral extension of the assembly's lower end 196 (i.e., along lateral axis 448 in FIG. 4A). In this configuration, the upper platform surface 320 is shaped and designed to receive (e.g., support) the assembly 144 in the mounted position (FIGS. 1B, 1C). In other embodiments, the platform surface 320 may have any other suitable design or shape for supporting the mounted assembly 144, which may be complimentary to the design or shape of the lower surface of the removable portion 172.

As exemplified in FIGS. 10A and 10B—platform section 308 may also house the lower conduit portion 164. As exemplified, the lower conduit portion 164 extends (i.e., along conduit axis 170) between the evacuation station air inlet 136, and an intermediate outlet port 328.

In the exemplified embodiments, the intermediate outlet port 328 is positioned adjacent the upper platform surface 320. In this position, when the assembly 144 is mounted to the base 148, the outlet port 328 interfaces (e.g., mates) with the assembly's air inlet 188. Accordingly, when the evacuation station 108 is operated (FIG. 2A), the outlet port 328 feeds air from the lower conduit portion 164 into the upper conduit portion 168 located inside the assembly 144. The portion of the airflow path 156—inside the lower conduit 164,and between the evacuation station air inlet 136, and the intermediate outlet port 328—can define an "air treatment member air flow feed path" 158*b* (FIG. 2A). It will be appreciated that the outlet port 328 may be provided at any location at which it will interface with the assembly's air inlet 188.

Optionally—as exemplified in FIGS. 10A and 10B—a seal 326 (e.g., a gasket or the like) may be disposed around, e.g., intermediate outlet port 328 to provide an air-tight sealed engagement between the outlet port 328, and the assembly's air inlet 188, when the assembly 144 is in the mounted position.

The base body 304 can also include the filter and motor housing section 312, adjacent to the platform mounting section 308. The filter and motor housing 312 generally houses the suction motor 152 and as well as the pre-motor filter 180 and post-motor filter 184. In other embodiments, the suction motor 152 and/or one or more filters 180, 184 may be housed inside the platform section 308.

As exemplified in FIGS. 10A-10B, the filter and motor housing 312 can also extend between a lower end 332 and an upper end 336, along an axis co-linear to motor axis 154, and may further include inward and outward-facing lateral ends 348*a*, 348*b*.

As exemplified in FIGS. 1B, when the air treatment assembly 144 is mounted to the base 148, an upper portion—of the inward-facing end 348*a*—may engage (and/or abut) the assembly's end wall 202.

The upper end 336 of filter and motor housing 312 may comprise an open end defining an intermediate air inlet 340 into the base 148. In particular, when the air treatment assembly 144 is mounted to the base 148 (FIGS. 1-3), the base's intermediate air inlet 340 aligns with the assembly's air outlet 192 (e.g., the downward facing opening 242), such that the assembly 144 is in fluid communication with the base 148. Accordingly—during operation of the evacuation station 108 (FIG. 2A)—air exiting the assembly's air outlet 192 may flow into the base 148, via the base's intermediate air inlet 340. It will be appreciated that the intermediate air inlet 340 may be provided at any location at which it will interface with the assembly's air outlet 192.

Figure 11B:
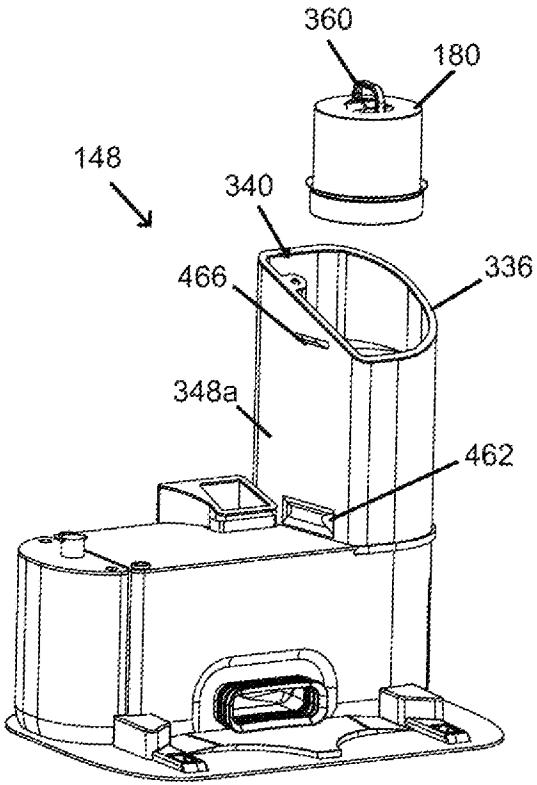
FIG. 11B is a perspective view of the stationary base portion, and showing the pre-motor filter removed (i.e., extracted) from the stationary base portion.
Figure 11A:
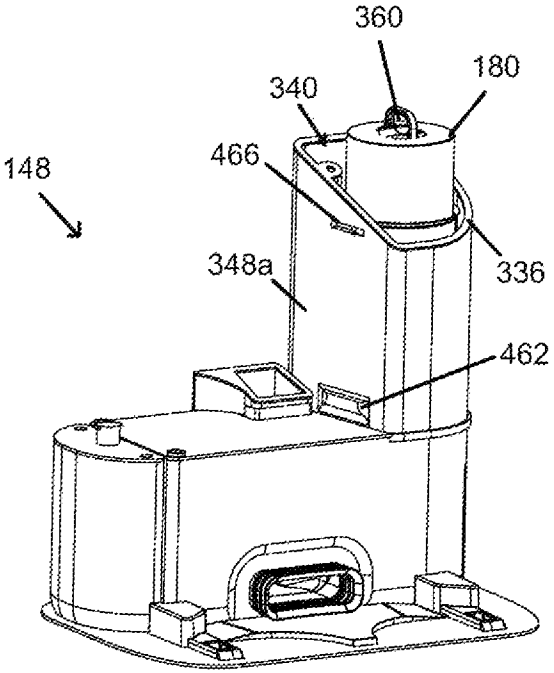
FIG. 11A is a perspective view of the stationary base portion, and showing the pre-motor filter inserted inside of the stationary base portion.

As best exemplified in FIGS. 11A-11C, when the air treatment assembly 144 is in the removed position, the open upper end 336—of the filter and motor housing 312—may be accessible, e.g., to a user. In various cases, this may allow a user to extract the pre-motor filter 180 from the stationary base portion 148.

For example, a user may extract the pre-motor filter 180 to clean, or otherwise replace the entire pre-motor filter 180. Otherwise, a user may clean or replace only a portion of the pre-motor filter 180. For example, a user may clean or replace only the foam portion 352.

Optionally, to facilitate extraction of the pre-motor filter 180, a filter handle 360 is provided at one end 354*a* of the filter grill portion 354. For example, the end 354*a* may define an upper end of the pre-motor filter 180 when the filter is inserted in the up-right position inside the filter and motor housing 312.

As exemplified in FIG. 11B, in the assembled state, the handle 360 may protrude through a radial inner opening 352*c* of the foam portion 352. In other embodiments, any other mechanism may be provided, at any other location, to facilitate extraction of the pre-motor filter 180.

FIGS. 24A and 24B exemplify an alternative embodiment of the stationary base portion 148 where the removable portion 172 comprises an external dirt container 162. In the exemplified embodiment, the stationary base portion 148 now houses a majority of the components of the evacuation station 108 (e.g., the air treatment member 146, suction device 152 and filters 180, 184). Further, in this embodiment, a lateral surface 568 of the base housing 304 may now form a mounting surface for receiving the removable dirt container 162.

Description of an Alignment and Mounting Mechanism for Removable Portion of the Evacuation Station The following is a discussion of an alignment and mounting mechanism for facilitating simplified mounting of the removable portion 172 to the station's base portion 148.

In exemplified embodiments, an alignment mechanism can be provided to ensure that the removable portion 172 is correctly aligned to be in fluid communication with the stationary base portion 148 when the stationary base portion is in the in-use position (i.e., for operating the evacuation station 108). Optionally, the alignment mechanism is also provided to prevent the removable portion 172 from inadvertently misaligning (e.g., displacing), relative to the base 148, during operation of the evacuation station 108. That is, the alignment mechanism can secure the removable portion 172 in the aligned position relative to the base 148 for operating the station 108 without the removable portion 172 inadvertently sliding-of the base 148.

FIGS. 12 to 14 and 24, exemplify an alignment and mounting mechanism 402 for facilitating aligned mounting of a removable portion 172, to the stationary base portion 148. The embodiment of FIGS. 12-14 exemplify an embodiment wherein the removable portion 172 comprises the air treatment assembly 144, and the alignment mechanism 402 is provided between the assembly 144 and the base 148. FIG. 24 exemplifies an alternative embodiment wherein the removable portion 172 comprises the removable dirt container 162, and the alignment mechanism 402 is disposed between the removable container 162 and the base 148.

In the exemplified embodiments, the alignment mechanism 402 comprises an alignment pin 404 provided on the removable portion 172 (e.g., air treatment assembly 144, or dirt container 162), and a pin-receiving hole 408 located on the base 148. In other embodiments, however, a reverse configuration is possible, where the alignment pin 404 is provided on the base 148, and the pin-receiving hole 408 is provided on the removable portion 172 (e.g., FIG. 16).

Any number of alignment pins 404 and corresponding holes 408 may be provided as part of the alignment mechanism, and each may have any suitable shape or design. For example, in the exemplified embodiments, the alignment pin 404 and receiving-hole 408 may have a generally circular cross-section shape (e.g., FIG. 14). In other embodiments, each of the pin 404 and hole 408 may have, for example, a triangular, rectangular or oval cross-section.

The alignment mechanism correctly aligns the removable portion 172, relative to the base 148, such that the removable portion 172 is blocked from mounting to the base 148 unless the alignment pin 404 and pin-receiving hole 408 align along a common alignment axis 406. The alignment axis 406 can be, for example, substantially vertical (FIGS. 12-14), substantially horizontal (FIG. 24), or otherwise orientated at any suitable angle relative to an upright station 108. The alignment axis 406 defines a mounting position wherein the removable portion 172 is orientable to be in fluid communication with the stationary base portion 148 for operating the evacuation station 108.

The alignment mechanism 402 may be provided at any suitable location on the removable portion 172 and the stationary base portion 148, such as to provide correct alignment of the two components.

Figure 12:
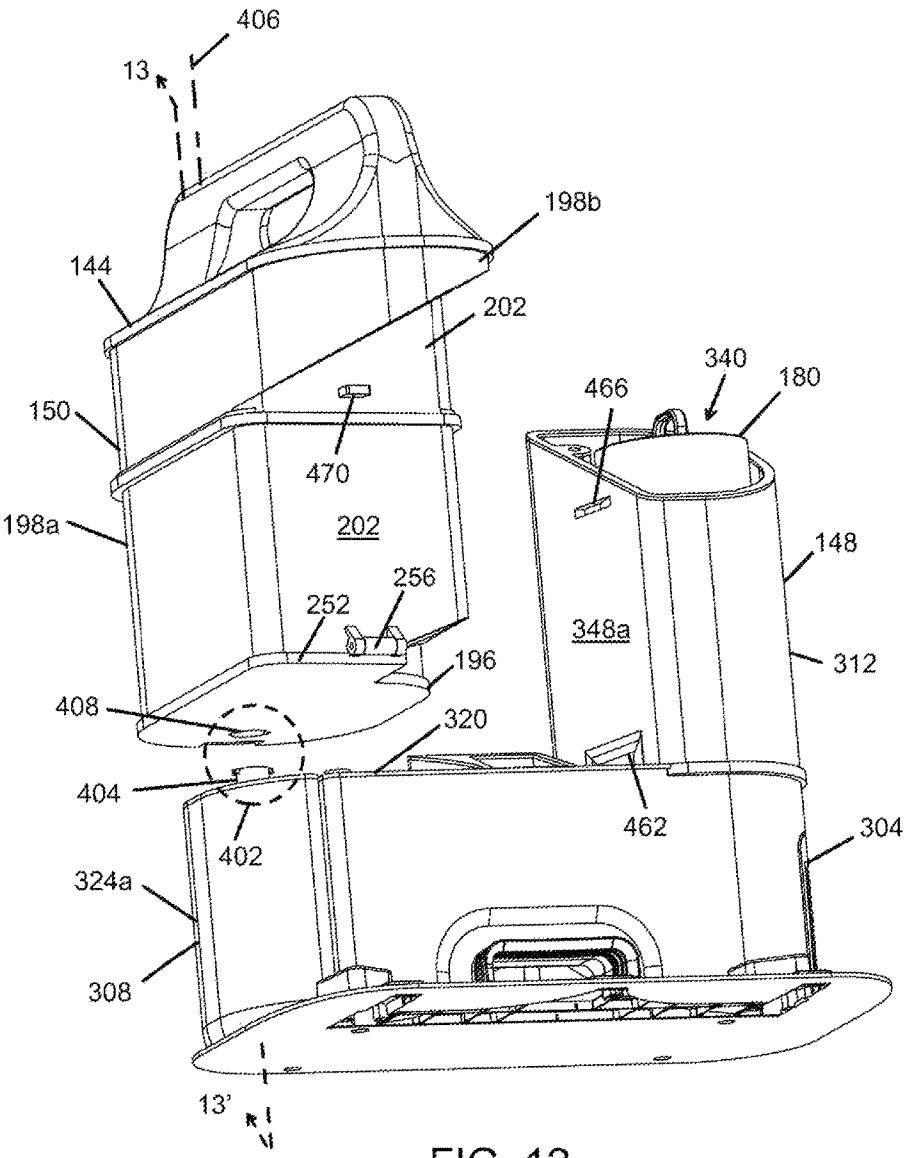
FIG. 12 is a perspective view of the air treatment assembly being mounted to the stationary base portion.
Figure 13A:
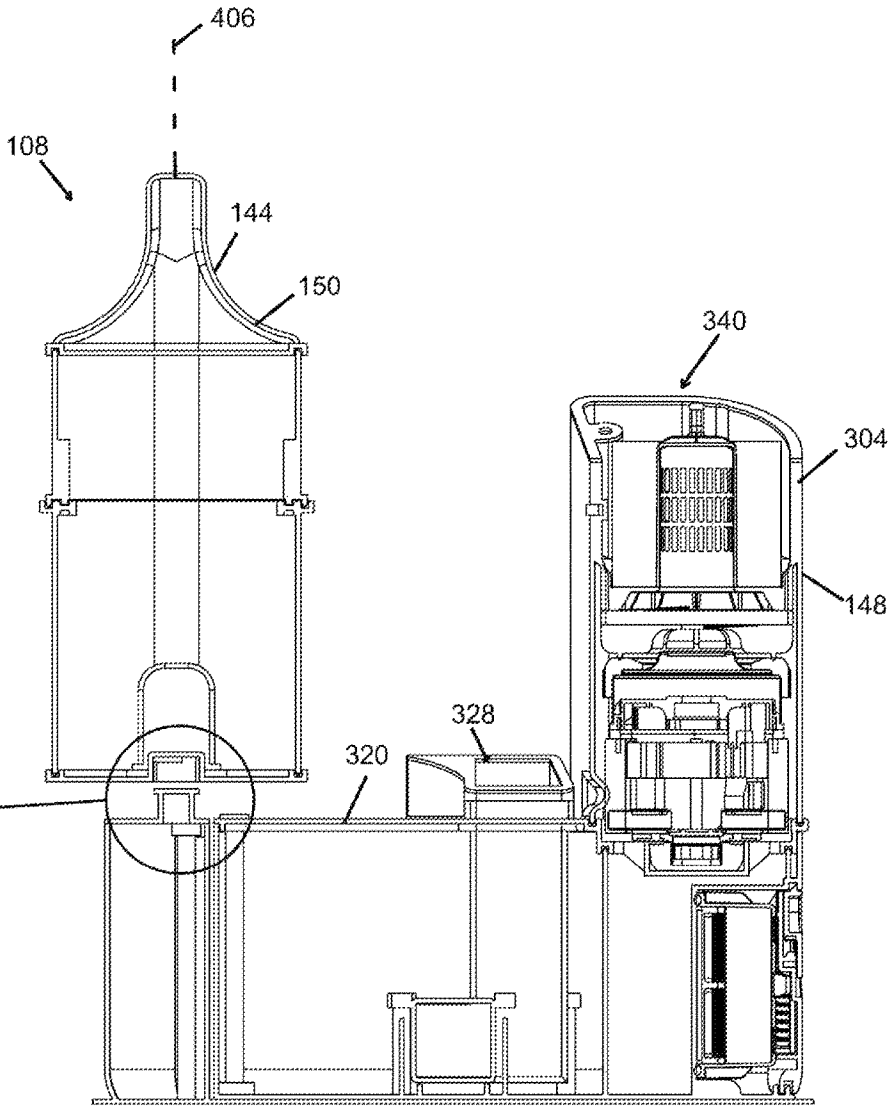
FIG. 13A is a cross-sectional view of FIG. 12, taken along the section line 13-13' of FIG. 12.
Figure 13B:
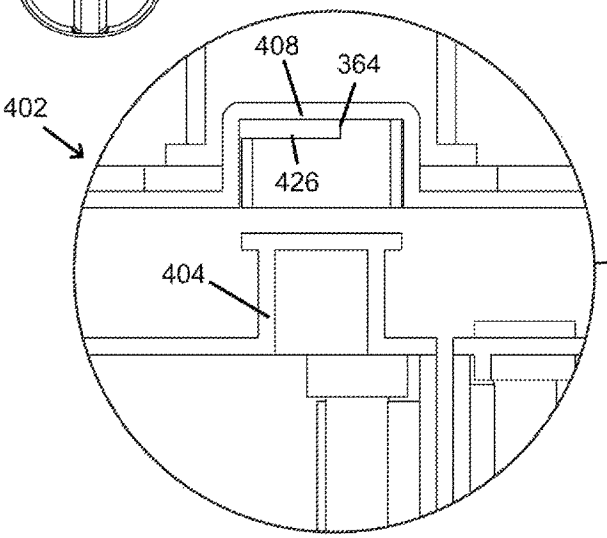
FIG. 13B is a close-up view of a portion of FIG. 13A, and showing an arrangement between an alignment pin and a pin-receiving hole.
Figure 13C:
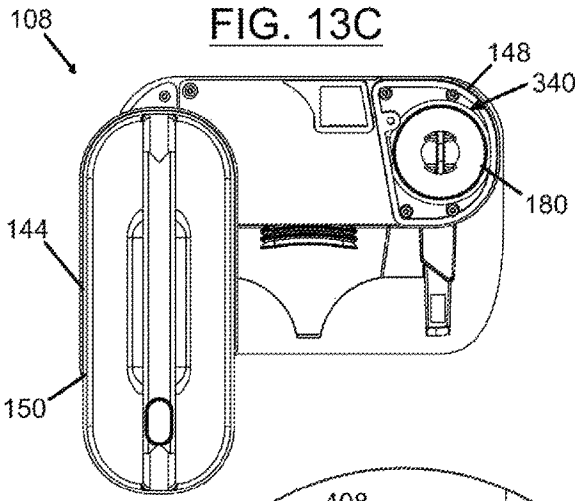
FIG. 13C is a top plan view of the arrangement of FIG. 13A.

As exemplified in FIGS. 12-14, the alignment pin 404 is located on the upper mounting surface 320 of base 148 (i.e., proximal the base's lateral end 324*a*), while the pin receiving-hole 408 is located on the assembly's lower end 196 (i.e., proximal the assembly's lateral face 198*a*). In some cases, a hole-forming member 410 may be located on the assembly's lower end 196 to form the pin-receiving hole 408 and be moveable with the door 252 (FIG. 6B).

Figure 16A:
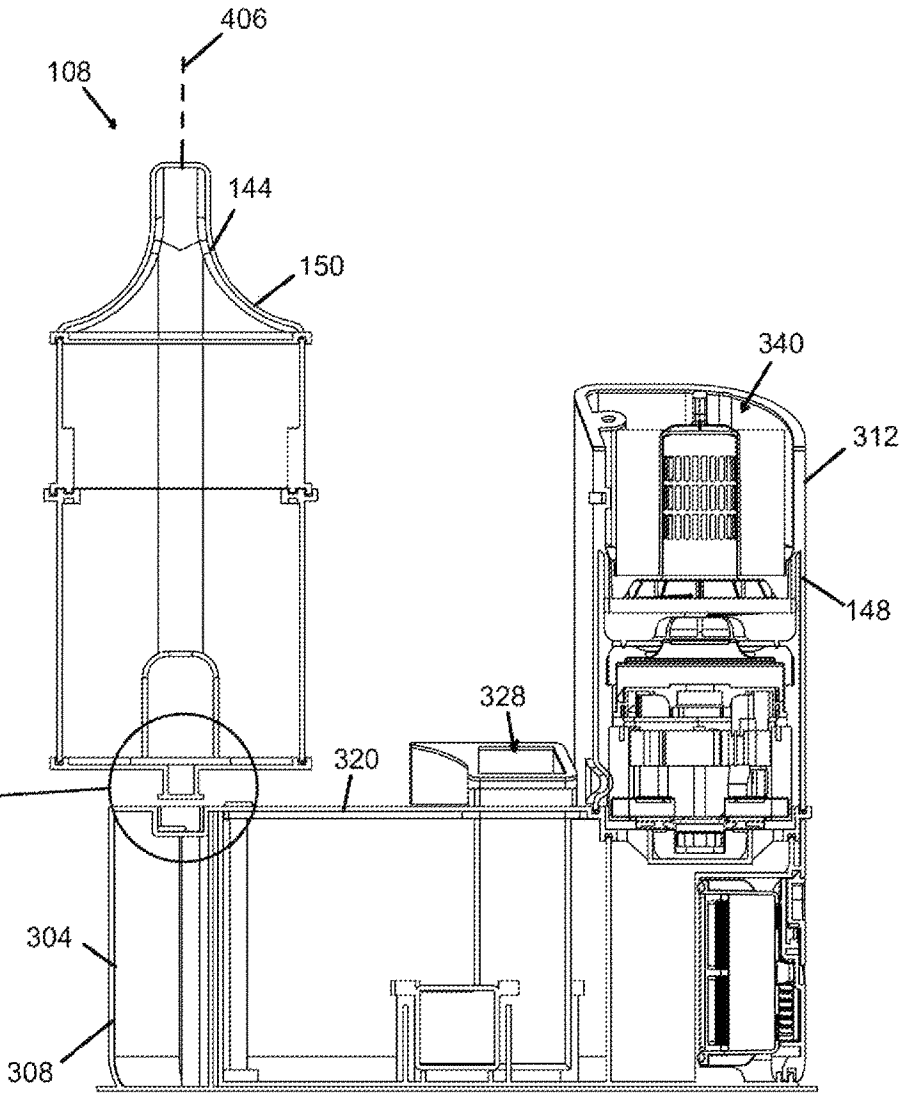
FIG. 16A is a cross-sectional view, taken along the section line 13-13' of FIG. 12, of an alternate embodiment in which the alignment pin is provided on the air treatment assembly and the pin-receiving hole is provided on the stationary base portion.
Figure 16B:
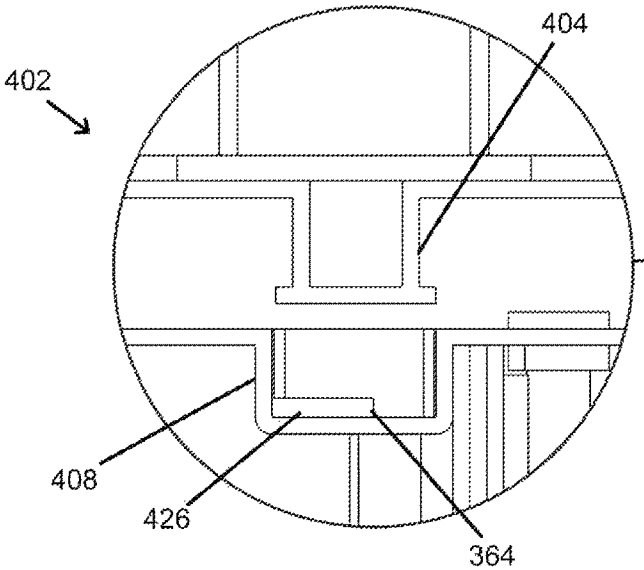
FIG. 16B is a close-up view of a portion of the cross-sectional view of FIG. 16A, and showing the alignment pin and pin-receiving hole.
Figure 16C:
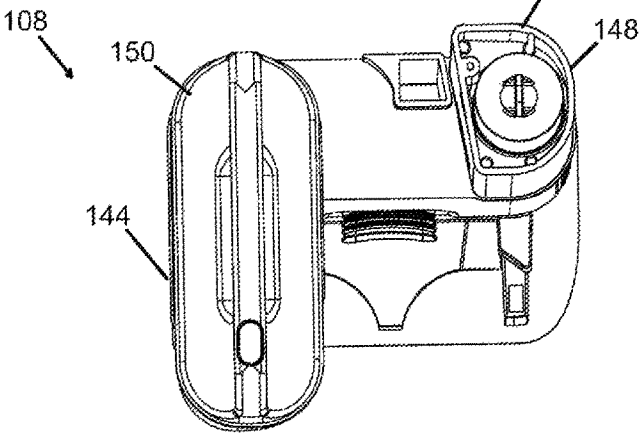
FIG. 16C is a top plan view of the arrangement of FIG. 16A.

FIG. 16 exemplifies an alternate embodiment wherein the locations of the pin 404 and hole 408 are reversed with respect to the assembly 144 and the base 148.

As exemplified in FIG. 24, the alignment pin 404 is provided on a lateral face 558*c* of the dirt container housing 558, while the alignment hole is located on the lateral surface 568 of the base housing 304. In other embodiments, the reverse configuration is also possible, whereby pin 404 is provided on the base 148, and the receiving-hole 408 is provided on the removable dirt container 172.

It will be appreciated that the removable portion 172 may be remounted on the stationary base by positioning the removable portion 172 on the stationary base with the alignment pin 404 positioned in the hole 148 (the mounted position). The removable portion 172 may then be moved (e.g., rotated) relative to the stationary base to position the removable portion 172 in the in-use position in which the air inlet and air outlet ports of the removable portion 172 mate with corresponding inlets and outlets of the stationary base.

As discussed subsequently, it will be appreciated that one or both of the removable portion and the stationary portion may be configured to provide and airtight seal between the air inlet and air outlet ports of the removable portion 172 mate with corresponding inlets and outlets of the stationary base. Alternately, in the embodiment of FIG. 24, the removable portion 172 may be moved (e.g., rotated) relative to the stationary base to position the removable portion 172 in the in-use position in which the dirt inlet of the removable portion 172 mates with a corresponding dirt outlet of the stationary base. It will be appreciated that one or both of the removable portion and the stationary portion may be configured to provide and dirt seal between the dirt inlet of the removable portion 172 and the dirt outlet of the stationary base.

Description of Locking Mechanism for the Removable Portion

In accordance with this aspect, an optional alignment position locking mechanism is provided for securing the removable portion 172 to the stationary base portion 148 unless the removable portion is in the removable position. An advantage of this design is that the removable portion 172 may only be removable from the stationary base portion 148 when the removable portion 172 is in a predetermined alignment position with respect to the stationary base portion 148.

As discussed previously, the removable portion 172 may be moveable relative to the stationary base portion 148 between a mounting or removable position and an in-use position. For example, the removable portion 172 may be rotatable about the alignment pin 404 between an in-use position and a removable position. Once the removable portion commences movement (rotation) away from the mounting position towards the in-use position, the alignment position locking mechanism may prevent the removable portion 172 from being separated from the stationary base portion 148.

Accordingly, in the in-use position, the alignment position locking mechanism locks (e.g., secures) the removable portion 172 to the base 148. In the removable position, the alignment position locking mechanism is unlocked such that removable portion is unsecured to the base 148 and a user is permitted to lift-away the removable portion 172 (e.g., for emptying) from the base 148. It will be appreciated that, optionally, the alignment position locking mechanism may be a separate mechanism to the alignment mechanism. Alternately, as exemplified herein, the alignment position locking mechanism may be integrated into the alignment mechanism, such that, e.g., the alignment pin may also function as the alignment position locking mechanism.

Figure 14A:
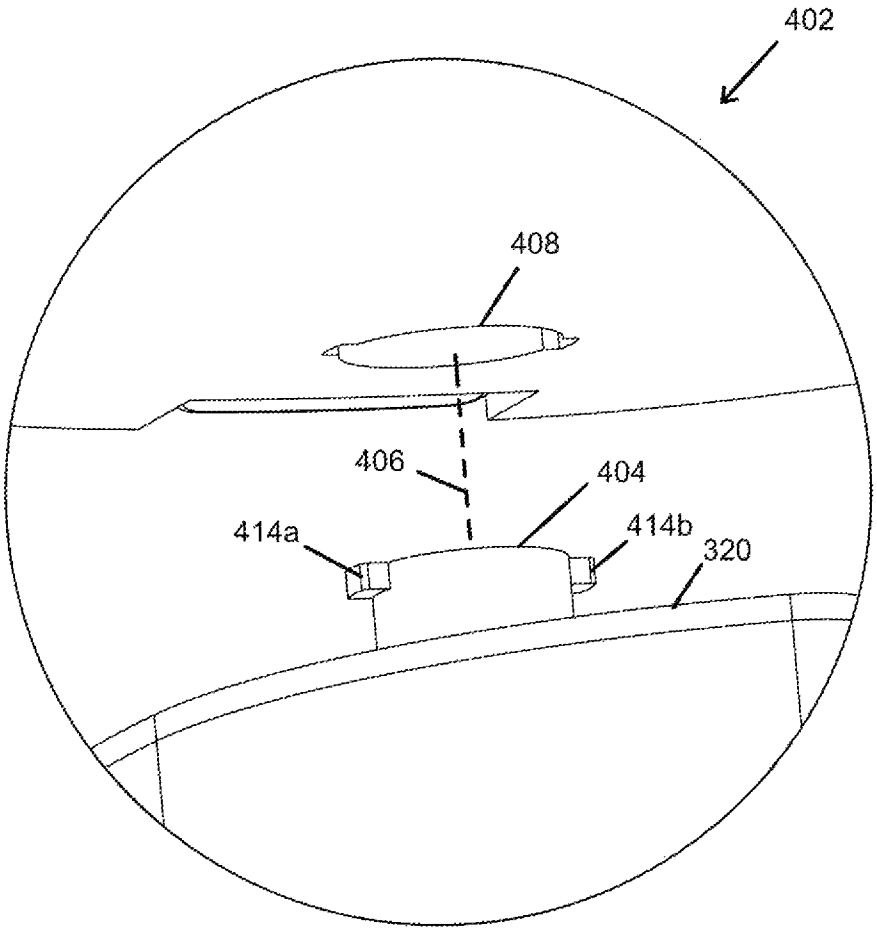
FIG. 14A is a close-up perspective view of an alignment pin and a pin-receiving hole.
Figure 14B:
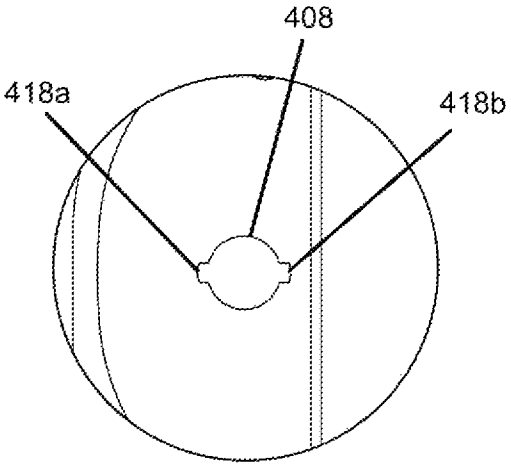
FIG. 14B is a bottom plan view of the pin-receiving hole of FIG. 14A.
Figure 14C:
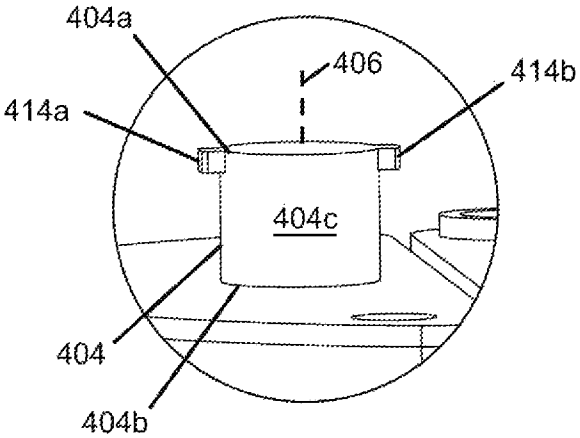
FIG. 14C is a top-side perspective view of the alignment pin of FIG. 14A.

FIGS. 14A-14C, exemplify an embodiment of an alignment position locking mechanism that is integrated into the alignment mechanism 402. In accordance with such an embodiment, the alignment pin 404 and the alignment hole 408 are configured such that the alignment pin 404 is removable from the alignment hole 408 in one or more specific alignment positions and, optionally, only in one alignment position.

As exemplified, the alignment pin 404 can include one or more locking flanges 414*a*, 414*b*. For example, alignment pin 404 may include a lateral surface 404*c* (i.e., extending between an upper end 404*a* and a lower end 404*b* of the alignment pin 404), and two locking flanges 414 that protrude radially-outwardly from a lateral surface 404*c*. Optionally, the locking flanges 414 may be located proximal the upper pin surface 404*a*.

Similarly, the pin-receive hole 408 may comprise flange-receiving grooves 418a, 418*b*. Flange-receiving grooves 418 are configured to receive pin flanges 414 when the removable portion 172 is in the mounted position and in the, or one of the, alignment positions. The pin-receiving hole 408 may include at least an equal number of grooves 418 as pin flanges 414 disposed on the pin 404.

In the exemplified configuration, the removable portion 172 is mounted to the base 148 by orienting the removable portion 172 to align the pin flanges 414 with the flange-receiving grooves 418 (an alignment position). FIG. 12, for example, exemplifies an embodiment where the assembly 144 must be rotated approximately 90° about alignment axis 406 with respect to the base 148 in order to align flanges 414 with grooves 418 such that the alignment pin 404 and the alignment hole 408 are in an alignment position and the removable portion 172 is therefore in the removable position. As exemplified in FIG. 12, in the removable position, the air treatment assembly 144 is rotated away from base 148 such that the assembly 144 is not in fluid communication with the base 148.

In other embodiments, flanges 414/grooves 418 may be located such that the removable position requires the removable portion 172 to be rotationally offset from the base 148 by an angle of, e.g., 20°, 30°, 40°, 45°, 50°, 60°, 120° or 180°. For example, in FIG. 24A, the flanges 414 are positioned such that the removable portion 172 requires a 45° rotation to mate flanges 414 with grooves 418.

Subsequent to mounting the removable portion 172 to the base 148 in the removable position, i.e., such that the flanges 414 are received inside of grooves 418 (FIG. 15C), the removable portion 172 may be rotated, about alignment axis 406, into the in-use position (FIGS. 1B-1D, 2A-2B).

FIGS. 17-20, for instance, exemplify various intermediate rotational positions between the removable position (FIG. 17) and the in-use position (FIGS. 1B-1D) for a removable air treatment assembly 144.

As exemplified in FIGS. 1B-1D and 24A , in the in-use position, the removable portion 172 has been rotated so as to be in fluid communication with the base 148, such that the evacuation station 108 may be operated (FIGS. 1B-1D, and 24A). That is, the assembly air inlet 188 mates with the base's intermediate air outlet 238, and the assembly air outlet 192 mates with the base's intermediate air inlet 340.

FIGS. 15A-15D exemplify various stages of the movement of the pin flanges 414 inside the pin-receiving hole 408 during rotation of the removable portion 172 to the in-use position. As exemplified, as the removable portion 172 is rotated into towards in-use position, the alignment pin flanges 414 rotate within the alignment hole 408 so as to now be aligned with grooves 418 and thereby secure (e.g., lock) the removable portion 172 to the base 148.

Figure 15A:
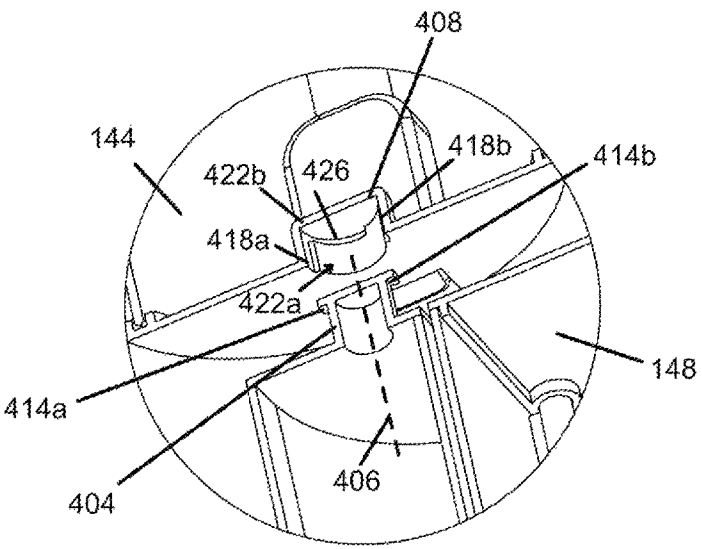
FIGS. 15A-15D are various close-up perspective cross-sectional views, taken along the section line 13-13' of FIG. 12, showing different stages of an alignment pin being received inside of a pin-receiving hole during mounting and rotation of an air treatment assembly relative to a stationary base portion.

As exemplified in FIG. 15A, each groove 418*a*, 418*b*, within the pin-receiving hole 408, extends (i.e., along alignment axis 406) between an open lower end 422*a*, and a closed upper end 422*b*. The closed upper end 422*b*, of each groove 418, connects to an inset channel 426. The inset channel 426 arcs partway around the inner circumference of the alignment hole 408.

Figure 15B:
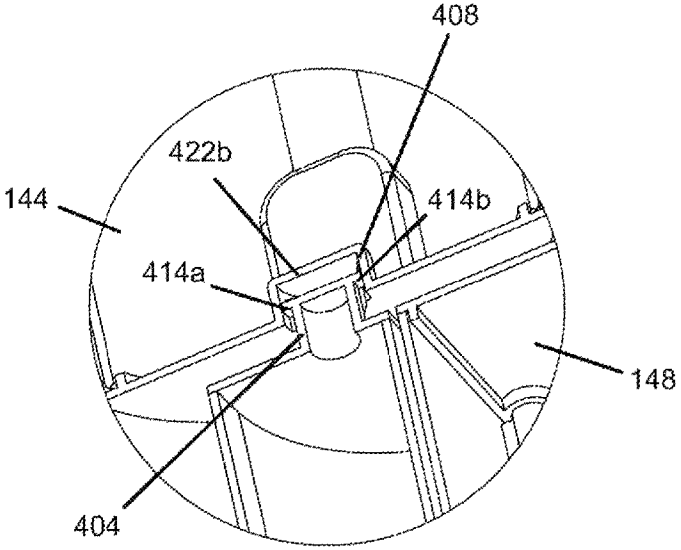
Figure 15C:
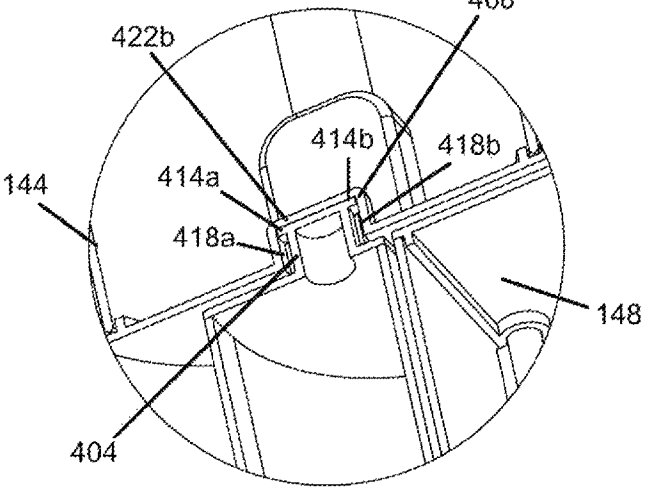

As exemplified in FIGS. 15B and 15C, during mounting of the removable portion, pin 404 is inserted into the alignment hole 408 (via grooves 418), until the pin flanges 414 align with the inset channel 426 (FIG. 15C).

Figure 15D:
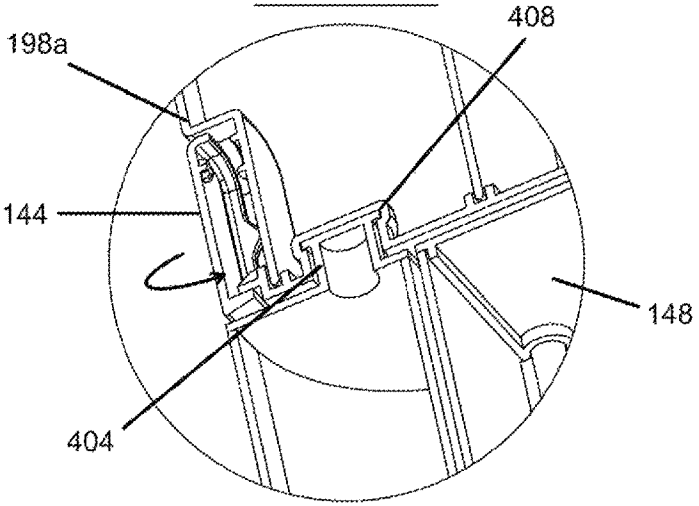

As exemplified in FIG. 15D, as the removable portion 172 is rotated from the removable position to the in-use position, the pin flanges 414 slide within the inset channel 426 until the removable portion 172 is completely rotated to the in-use position. In this position, the pin flanges 414 are offset (e.g., misaligned) with respect to the grooves 418. Accordingly, in the position of FIG. 15D, the flanges 414 are blocked from sliding axially out of the alignment hole 408 via the grooves 418. In this manner, the pin flanges 414 secure the removable portion 172 to the base 148, and the removable portion 172 is prevented from being lifted-away.

FIG. 13B exemplifies that each channel 426 may terminate (i.e., at termination point 364 in FIG. 13B), at a point when the removable portion 172 is fully rotated in the in-use position, so as to prevent over-rotation of the removable portion 172.

To remove the removable portion 172, the removable portion 172 may be reversely rotated, about alignment axis 406, back to the removable position, wherein the locking flanges 414 are aligned with the hole grooves 418. In this position, a user is permitted to remove (e.g., lift-away) the removable portion 172 from the base 148.

It will be appreciated that removable portion 172 and the stationary base portion 148 may have surfaces configured to retain or assist in retaining the removable portion 172 in the in-use position. For example, the upper inner surface of the alignment hole may have a cam surface. Accordingly, for example, as the alignment pin 404 rotates within alignment hole 408, an upper surface of the flanges 414 may cam along the upper inner surface of the alignment hole 408 to thereby draw the alignment pin 404 further into the alignment hole 408. In the in-use position, the contact of the alignment pin 404 with the cam surface may create a frictional engagement which secures or assists in securing the removable member 172 in the in-use position. Further, if a sealing gasket or the like is provided between mating inlets and outlets of the removable portion 172 and the stationary base portion 148, camming the flanges 414 along the cam surface may draw the port(s) of the removable portion 172 towards the port(s) of the stationary base 148 and compress the sealing gasket thereby forming or assisting in forming an air or dust tight seal between the removable portion 172 and the stationary base portion 148.

Alternately, other portions of the removable portion 172 and the stationary base portion 148 may be configured to form or assist in forming an air or dust tight seal between the removable portion 172 and the stationary base portion 148.

As exemplified in FIGS. 7-9, to facilitate rotation of the air treatment assembly 144 between the removable position (FIG. 17) and the in-use position (FIGS. 1C-1D), one or more edges of the assembly housing 150 and base housing 304 may have a slanted (e.g., sloped) design.

It will be appreciated that a slanted edge design (e.g., as contrasted to a flat or planar edge design), may minimize friction engagement of the assembly housing 150 to the base housing 304 during rotation of the assembly 144. This, in turn, provides users with smoother rotation of the assembly 144 relative to the base 148. Alternately, these slanted surfaces may function as cam surfaces.

As exemplified in FIGS. 7-9, each of the air treatment assembly's air inlet 188 and air outlet 192 may have respective sloped edges 246, 442 (FIG. 7). The sloped edges of the air treatment assembly 144 can complement sloped edge 344, 446 of the base's intermediate air inlet 340 and air outlet 328 (FIGS. 9C, 9D).

Figure 20B:
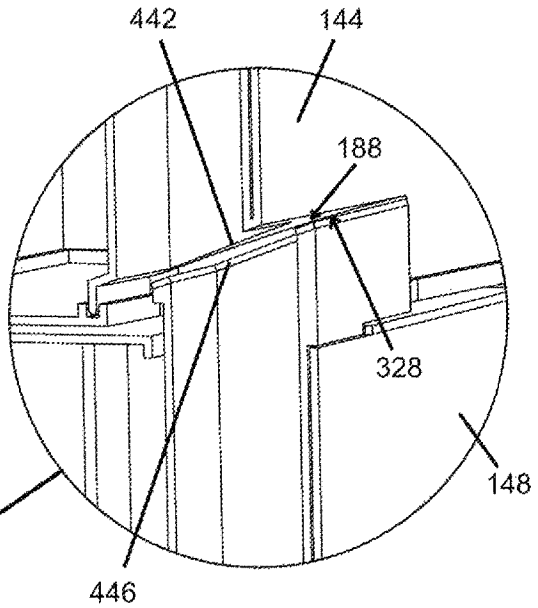
FIG. 20B is a close-up perspective view of a portion of the air treatment assembly and base portions of FIG. 20A.
Figure 20A:
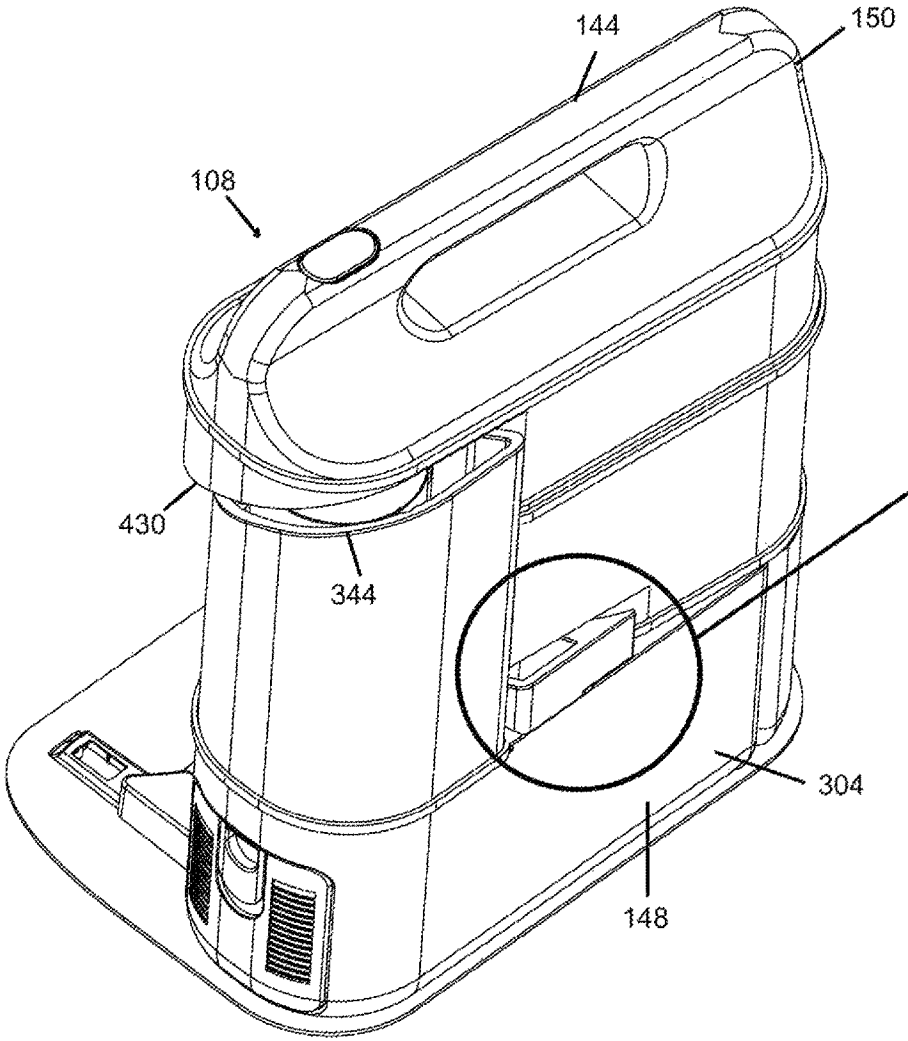
FIG. 20A is a rear perspective view of the air treatment assembly in a further rotated position.

In particular, in the vertical up-right position, each of the assembly and base edges may slope upwardly in the direction of rotation between the removable position (FIG. 17C) and the in-use position (FIGS. 1C-1D) (e.g., FIGS. 20A-20B).

More specifically—as exemplified in FIG. 7—the assembly's air inlet 188 and air outlet 192 may have respective edges 246, 442 which slope upwardly from a first end 246*a*, 442*a* to a second end 246*b*, 442*b*, such that the second end 246*b*, 442*b* is located vertically above the first end 246*a*, 442*a*. The first end 246*a*, 442*a* may be positioned proximal a front end 430*a* of the assembly housing 150, while the second end 246*b*, 442*b* may be positioned proximal the housing rear end 430*b*.

As exemplified in FIGS. 9B and 9C, the base 148 can include an intermediate air inlet 340 and air outlet 328 also having sloped edges 344, 446. The edges slope upwardly from a respective first end 344*a*, 446*a* to a respective second end 344*b*, 446*b*, such that the second end 246*b*, 446*b* is located vertically above the first end 344*a*, 446*a*. The first and second ends may be also positioned proximal a front and rear end 434*a*, 434*b* of the base housing 304, respectively, Referring to FIGS. 19-21, an advantage of the slanted (or sloped) design is that the assembly's air inlet 188, as well as the assembly's air outlet 192 (i.e., defined by the overhanging portion 238) may seamlessly slide over the base's intermediate air outlet 328 and inlet 340, when the assembly 144 is rotated to the in-use position. In particular, the inlet/outlet edges may not engage until the assembly 144 is in the fully rotated in-use position, in which cases the edges meet (e.g., abut) at a juncture interface 438 (FIGS. 1B-1D).

Figure 19B:
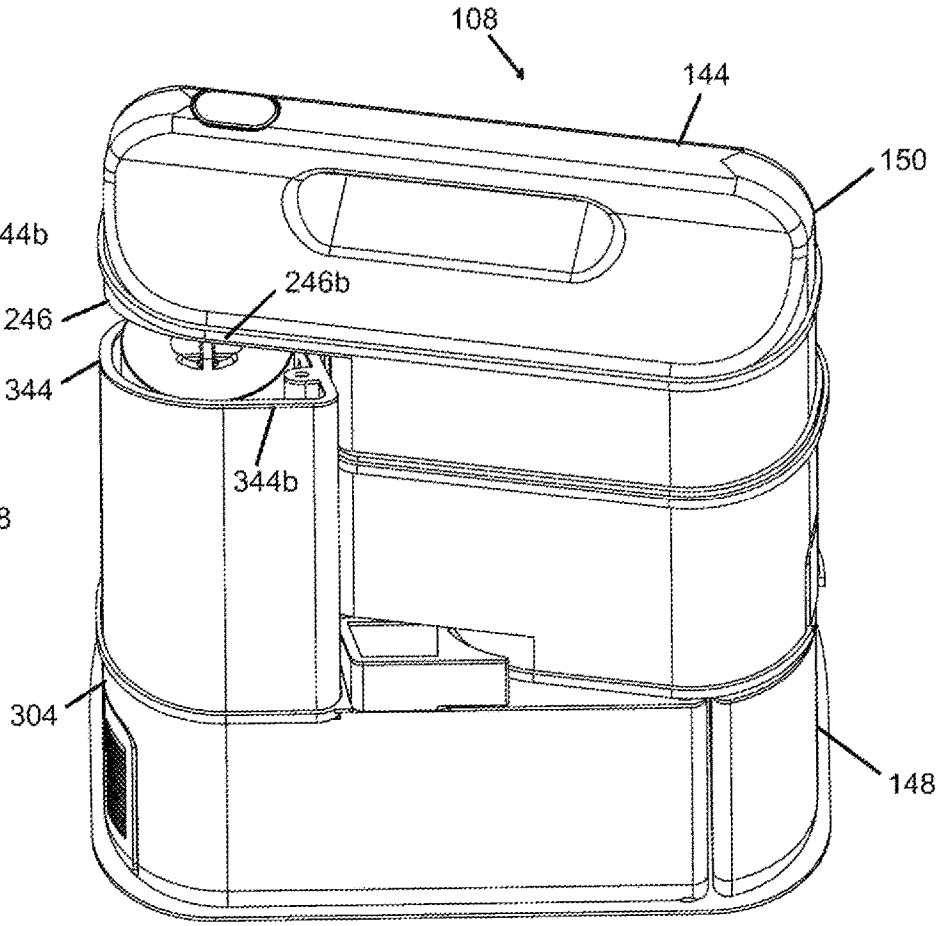
FIG. 19B is a rear perspective view of the arrangement of FIG. 19A.
Figure 19A:
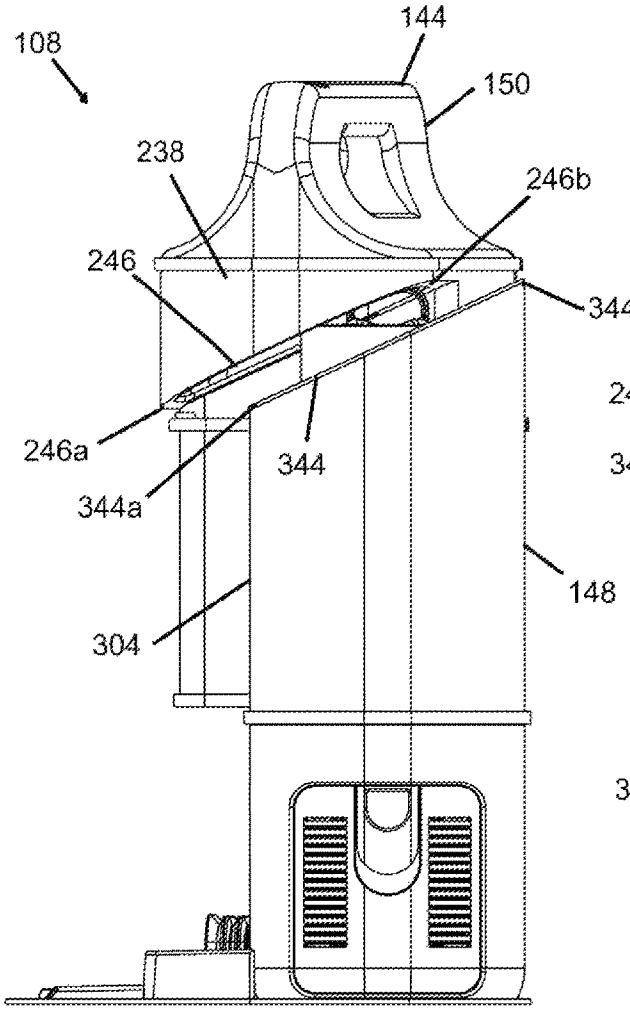
FIG. 19A is a side perspective view of the air treatment assembly in a further partially rotated position relative to the stationary base portion.

In contrast, a planar design may cause considerable friction engagement between the assembly and base when the assembly body 150 overlaps the base housing 304 during rotation to the in-use position (i.e., FIGS. 19-20). This, in turn, would demand a user exert considerable effort to rotate the assembly 144 between the removable and in-use positions.

Each of the inlet and outlet edges, i.e., on the assembly 144 and base 148, may slope by any suitable extent. For example—in the upright positions—each of the edges 246, 344, 442, 446 may slope—relative to the vertical plane—at an incline of 10°, 20°, 30°, 40°, 45°, etc.

Additionally, in some embodiments, only a portion of each edge may be sloped, while the remaining portion may be, e.g., substantially flat. For example, in the upright position, an upper or lower portion of each edge may be sloped, while the remaining portion may be planar. In some cases, anywhere between 10% to 80% of each edge can be sloped.

Preferably, a slanted design is also provided along the end wall 202 of the air treatment assembly 144 (FIG. 4A), as well as the lateral surface 348*a* of the base filter and motor (filter and motor) housing 312 (FIG. 9A).

More particularly, as exemplified in FIGS. 4A and 9A, each of the assembly end wall 202, and the filter and motor housing's lateral face 348*a*, can extend between a first end 202*a*, 348$a_1$ (i.e., located proximal a front face 430*a*, 434*a* of the respective assembly or filter and motor housing), and a respective second end 202*b*, 348$a_2$ (i.e., located proximal a rear face 430*b*, 434*b* of the respective assembly or filter and motor housing).

As exemplified, each first end 202*a*, 348$a_1$ may be located forwardly of the respective second end 202*b*, 348$a_2$, i.e., along an axis transverse to a longitudinal axis 448, 454 of the assembly or filter and motor housing body, such that each surface slants along a respective slanting angle 450, 458.

In various cases, the slanting angle 450 of the assembly end wall 202 (FIG. 4A) may be substantially equal to the slanting angle 458 of the filter and motor housing's lateral face 348*a* (FIG. 9A).

It will be appreciated that the port(s) of one or both of the removable portion 172 and the stationary base portion 148 may have a sealing gasket. In such a case, the movement of the removable portion to the in-use position may result in the sealing gasket being compressed to thereby form or assist in forming an air or dust tight seal.

It will also be appreciated that, using a slanted surface, the engagement of the mating slanted surfaces of the removable portion 172 and the stationary base portion 148 when the removable portion 172 is in the in-use position may limit further rotation of the removable portion 172 relative to the stationary base portion 148 past the in-use position and thereby ensure alignment of the mating port(s) of the removable portion 172 and the stationary base portion 148. Further, the slanted surfaces may compress or assist in compressing s sealing gasket.

Optionally, as exemplified in FIGS. 11A-11B, the lateral surface 348*a* of the base housing 304 may include one or more cavity slots. For instance, lateral surface 348*a* may include a first slot 462 and a second slot 466. In the upright position, the second slot 466 may be located vertically above the first slot 462.

Figure 18B:
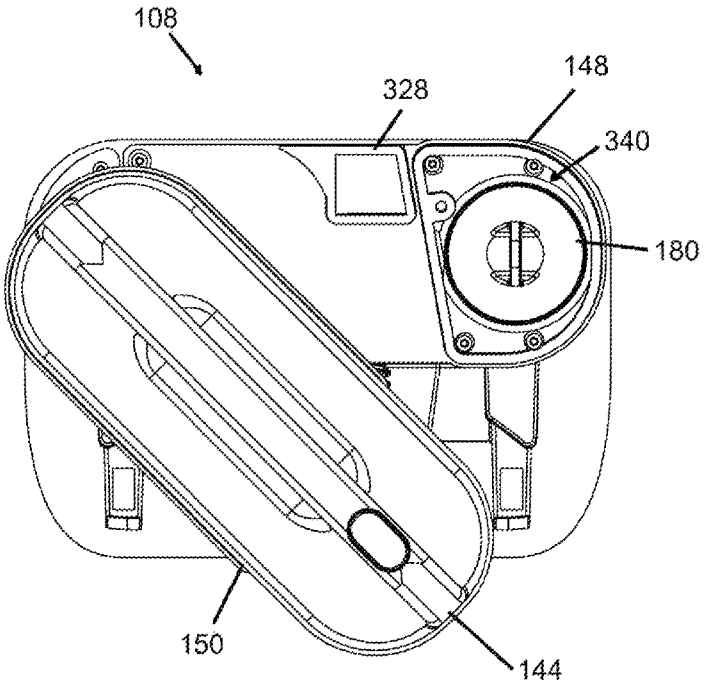
FIG. 18B is a top plan view of the arrangement of FIG. 18A.
Figure 18A:
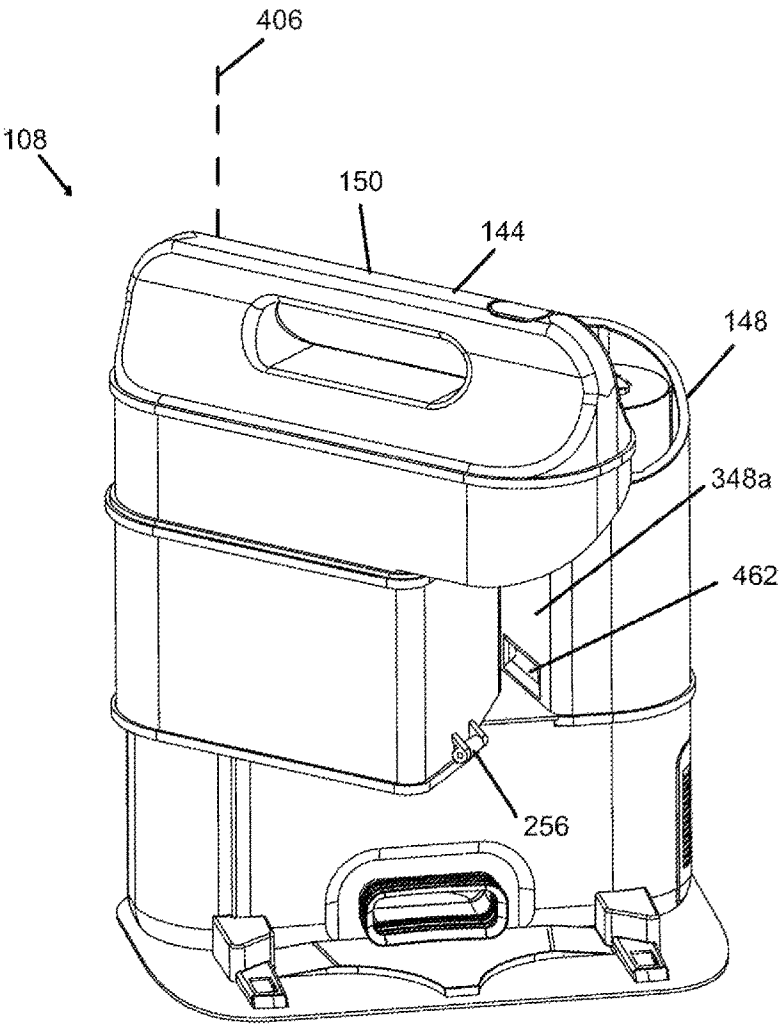
FIG. 18A is a front perspective view of the air treatment assembly in a partially rotated position.

As exemplified in FIGS. 2 and 18A, the lower slot 462 may be disposed to receive the hinge 256, of the air treatment assembly 144, in the rotated in-use position (FIG. 2). Similarly, as best exemplified in FIGS. 2 and 12, the upper slot 466 may be positioned to receive a blocking member 470, radially protruding from the assembly's end wall 202. Accordingly, as the air treatment assembly 144 is rotated into the in-use position, the assembly's hinge 256 and blocking member 470 may each be received into their respective slots 462, 466. Owing to the forward slanted design of the base's side surface 348*a* (FIG. 9A), the slanted slots 462, 466 also slant forwardly to engage the assembly's hinge 256 and blocking member 470 and "block" over-rotation of the air treatment assembly 144.

Figure 17B:
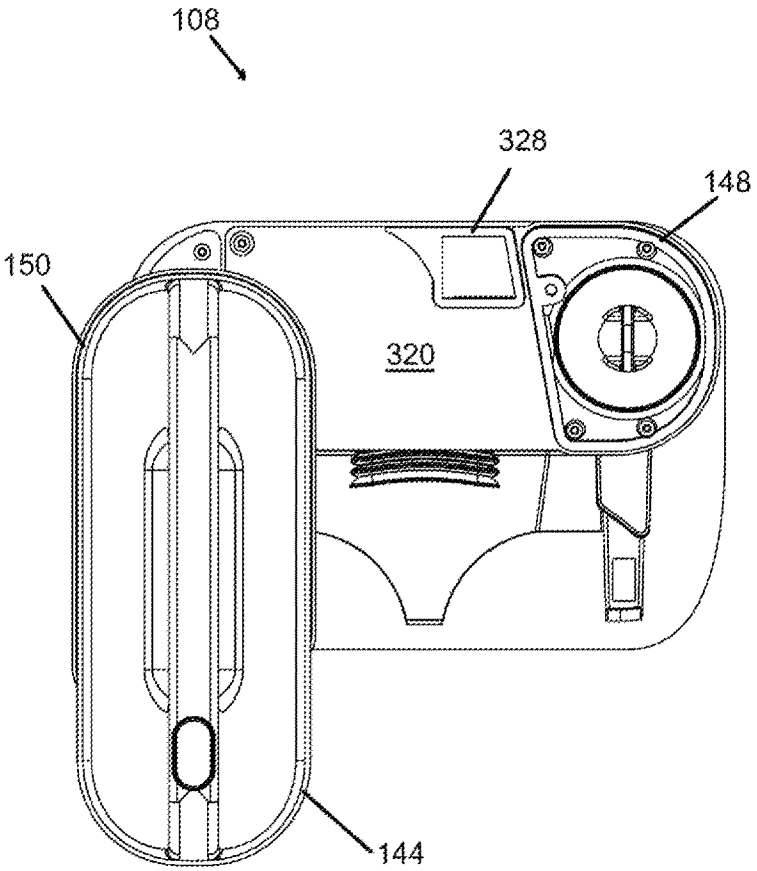
FIG. 17B is a top plan view of the arrangement of FIG. 17A.
Figure 17A:
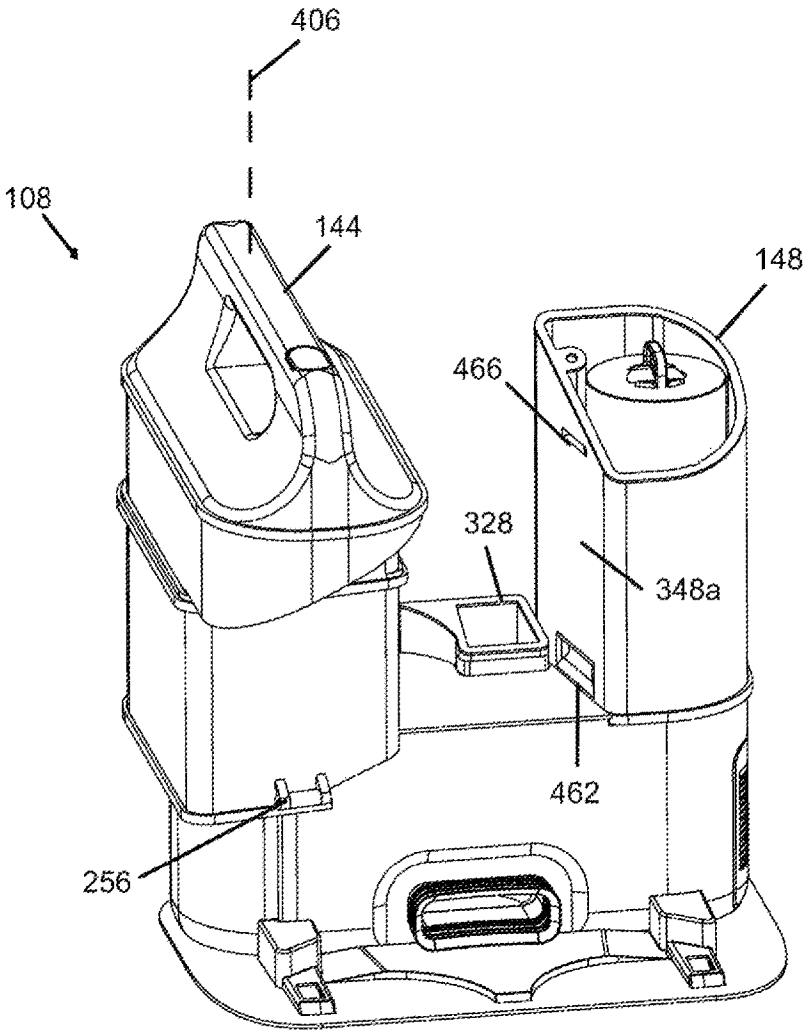
FIG. 17A is a front perspective view of the air treatment assembly in a removable position.

Optionally, as discussed subsequently, an in-use position locking mechanism may be provided to lock (e.g., secure) the removable portion 172 in the rotated in-use position. In particular, the in-use position locking mechanism can prevent the removable portion 172 from inadvertently reversely rotating back to the removable position (FIG. 17).

FIGS. 7-9 and 21-23 exemplify embodiments of the locking mechanism where the removable portion 172 comprises the air treatment assembly 144.

In the exemplified embodiments (FIGS. 7 and 9), the locking mechanism comprises a pin-in-hole design. For example, the assembly housing 150 may include a lock pin 486 (FIG. 7), receivable inside a lock hole 490 on the base housing 304 (FIG. 9) when the assembly 144 is in the rotated in-use position.

As exemplified in FIGS. 7A and 7C—the lock pin 486 protrudes from the edge 246 surrounding the assembly air outlet 192. As exemplified in FIGS. 9B and 9C, the lock hole 490 is similarly provided on an edge 344 surrounding the intermediate base air inlet 340.

Description of Locking Mechanism for Securing the Removable Portion in the In-Use Position In accordance with this aspect, an optional in-use position locking mechanism is provided for securing the removable portion 172 to the stationary base portion 148 in the in-use position. The in-use position locking mechanism locks (e.g., secures) the removable portion 172 to the base 148 in the in-use position such that the removable portion 172 is positioned to be in fluid communication with the base 148, such that the evacuation station 108 is operable. An advantage of this aspect is that the removable portion may be maintained in the in-use position until the in-use position locking mechanism is released which enables the removable portion 172 to move to the removal position. Accordingly, the in-use position locking mechanism may prevent inadvertent movement of the removable portion 172 from the in-use position (e.g., during operation of the evacuation station 108). Rather, a user must actively disengage the in-use position locking mechanism so as to move (rotate) the removable portion 172 to the removable position to allow dismounting. It will be appreciated that the in-use position locking mechanism may be used by itself with any removable portion 172. Alternately, it may be used in conjunction with the alignment position locking mechanism.

Figure 21C:
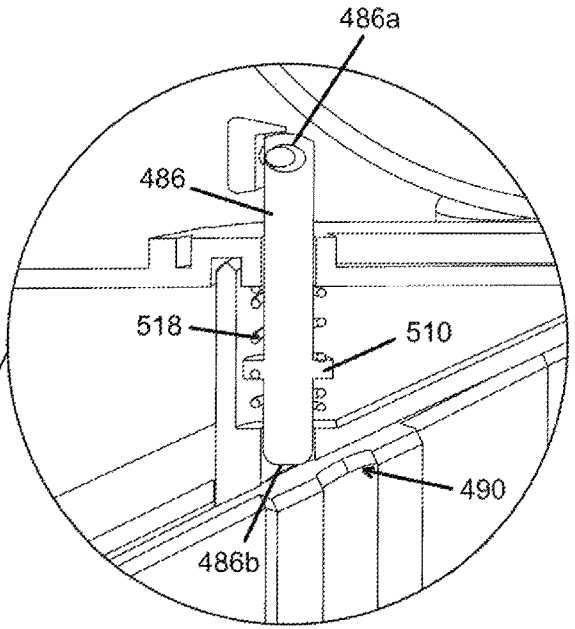
FIG. 21C is a close-up of a portion of the cross-sectional view of FIG. 21B, and showing a rotational lock mechanism in an unlocked position.
Figure 21B:
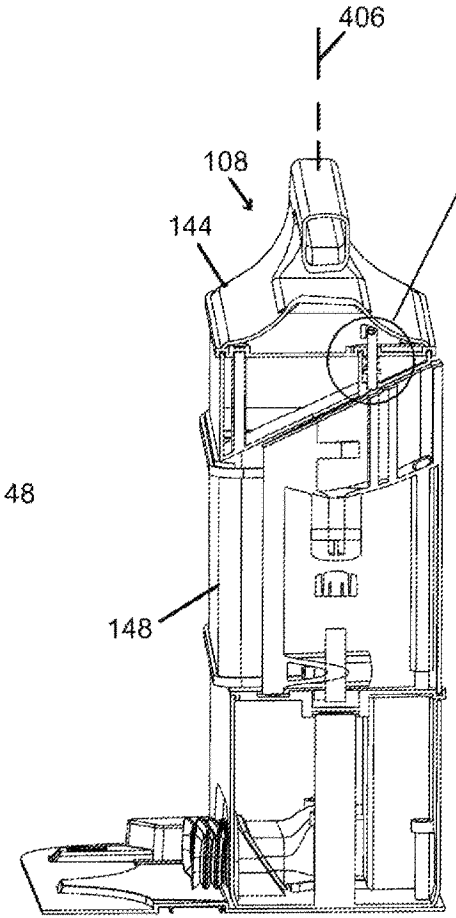
FIG. 21B is a cross-sectional view of the air treatment assembly and the stationary base portion, taken along the section line 21-21' of FIG. 21A.
Figure 21A:
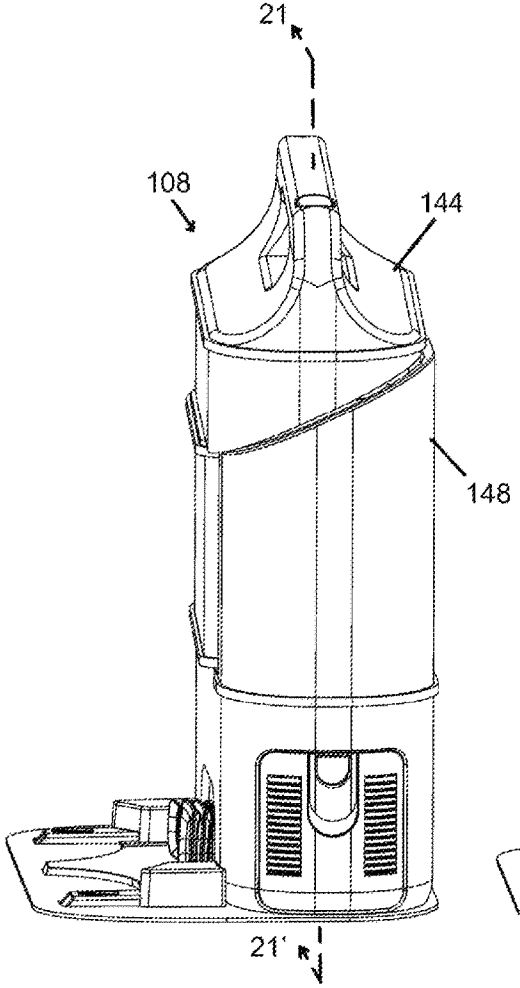
FIG. 21A is a side perspective view of the air treatment assembly in still yet a further rotated position.
Figure 22B:
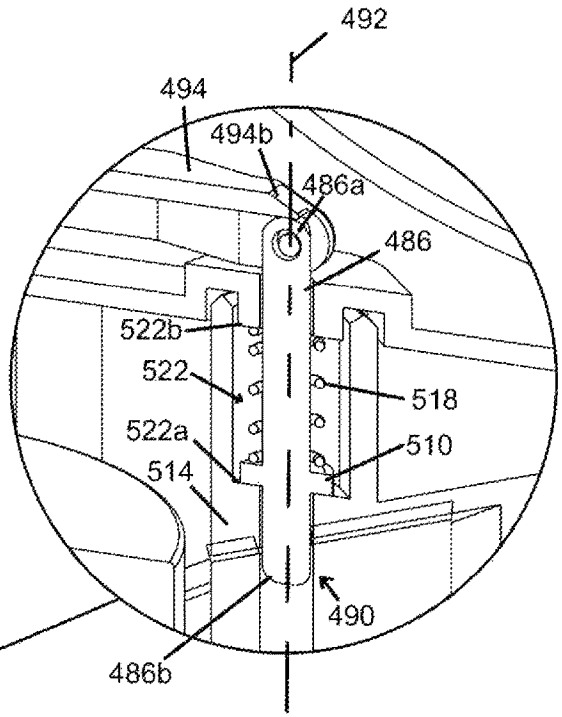
FIG. 22B is a further close-up view of a portion of FIG. 22A, and showing the rotational lock mechanism in the locked position.
Figure 22A:
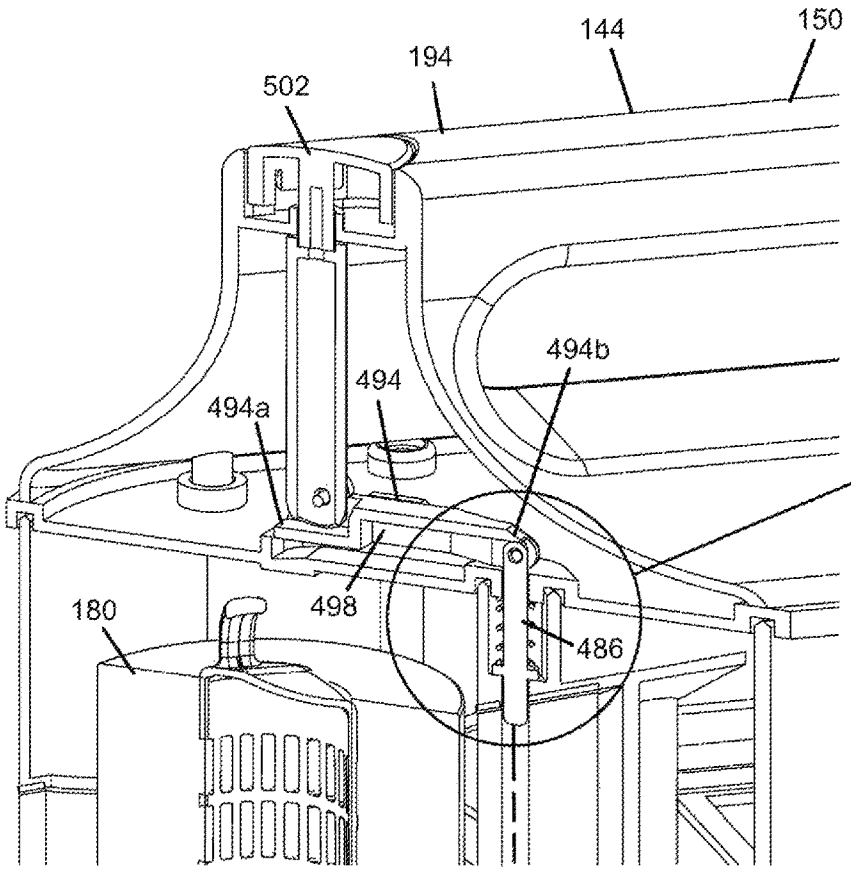
FIG. 22A is a close-up cross-sectional view of the air treatment assembly and base portion, taken along the section line 21-21' of FIG. 21A, and showing the rotational lock mechanism in a locked position.
Figure 23B:
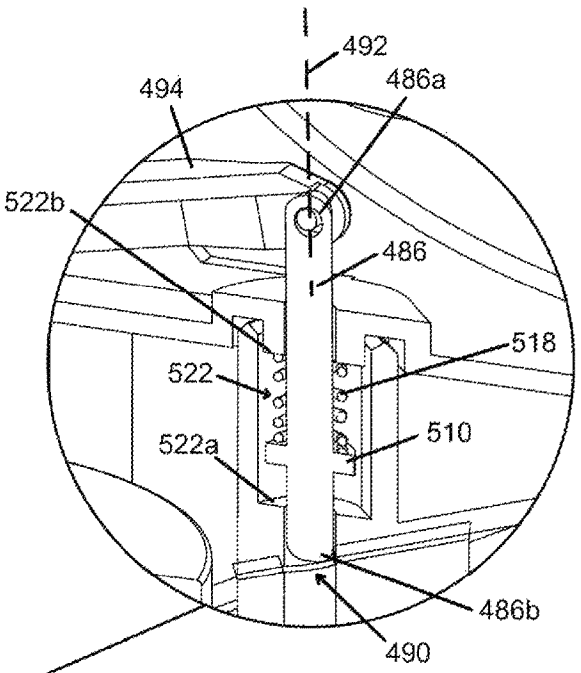
FIG. 23B is a further close-up view of a portion of FIG. 23A, and showing the rotational lock mechanism in an unlocked position.
Figure 23A:
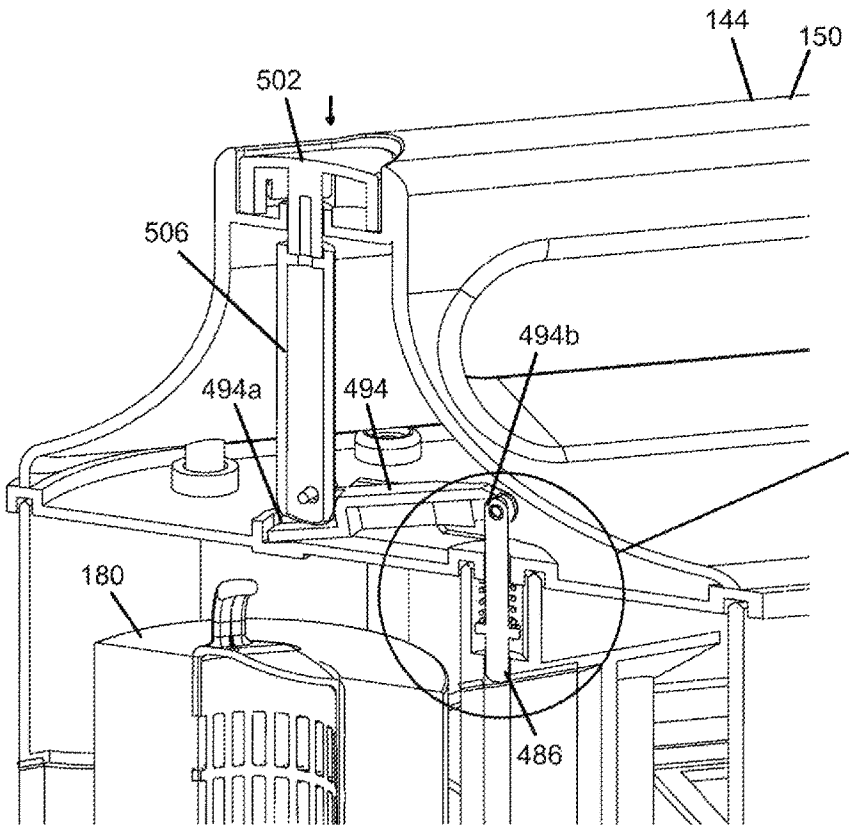
FIG. 23A is a close-up cross-sectional view of the air treatment assembly and base portion, taken along the section line 21-21' of FIG. 21A, and showing the rotational lock mechanism in an unlocked position.

FIGS. 21-23 exemplify an in-use position locking mechanism which comprises a lock pin 486 and a lock hole 490. As exemplified, the lock pin 486 is moveable between a locked position (FIG. 22), and an unlocked position (FIG. 23), relative to the lock hole 490.

In the locked position (FIG. 22), the pin 486 is aligned with, and received inside the lock hole 490 to prevent rotational movement of the air treatment assembly 144 relative to the base 148. In the unlocked position (FIGS. 21 and 23), the pin 486 is removed from the lock hole 490 to allow free rotational motion of the assembly 144 relative to the base 148.

Locking pin 486 may be translated between the locked position and unlocked position in any manner known in the art. For instance, as exemplified in FIG. 22B, the lock pin 486 can comprise a longitudinal member, extending between a first and second end 486*a*, 486*b* along a pin alignment axis 492. The second pin end 486*b* is receivable inside the lock hole 490 in the locked position (FIG. 22), while the first pin end 486*a* is rotatably connected to a lever member 494.

Lever member 494 may extend between a first lever end 494*a* and a second lever end 494*b*, along an axis transverse to the pin alignment axis 492 (or otherwise, along any other suitable axis). The second lever end 494*b* may be rotatable coupled to the first pin end 486*a*. In the exemplified embodiment, the lever member 494, itself, is pivotally mounted to a portion 498 of the assembly housing 150.

To translate the pin 486 between the locked and unlocked positions, a lock activation mechanism 502 (e.g., a button or the like) is provided on the exterior of the assembly housing 150. Optionally, the activation mechanism 502 is disposed at the upper end 194 of the assembly housing 150, such as to be accessible to a user.

When it is desired to translate the lock pin 486 into the unlocked position (FIG. 23), a user may depress the activation button 502. For example, the button 502 is depressed along an axis parallel to the pin axis 492. This, in turn, causes the button 502 to depress an extended member 506, which applies a force to the first lever end 494*a* (i.e., along the direction of the pin axis 492), which pivots the lever 494 to lift pin 486 out of the pin hole 490.

Optionally, as exemplified in FIG. 22B, the pin 486 can include a radial flange 510 which—in the locked position (FIG. 22)—engages a surface 514 of the assembly housing 150. Engagement of the pin flange 510 with the surface 514 can delimit movement of the pin 486 into the lock hole 490, along the pin axis 492.

Optionally, a biasing spring 518 is provided to bias the pin 486 in the locked position. For example, the pin 486 may be located within a pin cavity 522 (FIG. 22B) that extends, in the upright position, along the pin axis 492 between a lower surface 522*a* and an upper surface 522*b*. Accordingly, the biasing spring 518 may be provide between the pin flange 510 and the upper cavity surface 522. The biasing spring 518 can be biased in the expanded position (FIG. 22) to push the lock pin 486 into the locked position.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples but should be given the broadest interpretation consistent with the description as a whole.

The invention claimed is:

1. An evacuation station for a surface cleaning apparatus, the evacuation station comprising:

a) an air flow path extending from an evacuation station air inlet to an evacuation station air outlet;

b) a stationary base portion comprising a pre-motor filter chamber in which a pre-motor filter is removably receivable; and, c) a removable portion that is moveable from an in-use position in which the removable portion is mounted to the stationary base portion to a removed position in which the removable portion is removed from the stationary base portion, the removable portion comprising an air treatment assembly comprising an air treatment member, the air treatment member is positioned upstream of the pre-motor filter when the removable portion is in the in use position, wherein, the pre-motor filter is exposed when the removable portion is removed from the stationary base portion.

2. The evacuation station of claim 1 wherein the pre-motor filter is removable upwardly.

3. The evacuation station of claim 1 wherein the pre-motor filter comprises a pre-motor filter media and a face of the pre-motor filter media is visible from above when the removable portion is removed from the stationary base portion.

4. The evacuation station of claim 1 wherein, in use, air travels downwardly into the pre-motor filter chamber.

5. The evacuation station of claim 1 wherein the pre-motor filter is positioned above a suction motor when the pre-motor filter is positioned in the pre-motor filter chamber.

6. The evacuation station of claim 1 wherein the pre-motor filter is positioned above the evacuation station air outlet when the pre-motor filter is positioned in the pre-motor filter chamber.

7. The evacuation station of claim 1 wherein the air treatment member comprises a plurality of walls and at least one of the walls has a porous wall section.

8. The evacuation station of claim 7 wherein at least two of the walls have a porous wall section.

9. The evacuation station of claim 1 wherein the removable portion further comprises a handle and, when the removable portion is in the in use position, the handle overlies the air treatment member.

10. The evacuation station of claim 9 wherein, when the removable portion is in the in use position, the handle also overlies the pre-motor filter chamber.

11. An evacuation station for a surface cleaning apparatus, the evacuation station comprising:

a) an air flow path extending from an evacuation station air inlet to an evacuation station air outlet;

b) a stationary base portion comprising a pre-motor filter chamber in which a pre-motor filter is removably receivable; and, c) a removable portion that is moveable from an in-use position in which the removable portion is mounted to the stationary base portion to a removed position in which the removable portion is removed from the stationary base portion, the removable portion comprising an air treatment assembly comprising an air treatment member, the air treatment member is positioned upstream of the pre-motor filter when the removable portion is in the in use position, wherein, the pre-motor filter is removable upwardly when the removable portion is removed from the stationary base portion.

12. The evacuation station of claim 11 wherein the pre-motor filter comprises an annular filter media with a downstream interior air flow passage.

13. The evacuation station of claim 11 wherein the pre-motor filter has a handle which is exposed when the removable portion is removed from the stationary base portion.

14. The evacuation station of claim 11 wherein an upper end of the pre-motor filter chamber is opened when the air treatment assembly is removed from the stationary base portion.

15. The evacuation station of claim 11 wherein, in use, air travels downwardly into the pre-motor filter chamber.

16. The evacuation station of claim 11 wherein the pre-motor filter is positioned above a suction motor when the pre-motor filter is positioned in the pre-motor filter chamber.

17. An evacuation station for a surface cleaning apparatus, the evacuation station comprising:

a) an air flow path extending from an evacuation station air inlet to an evacuation station air outlet;

b) a stationary base portion comprising a pre-motor filter chamber in which a pre-motor filter is removably receivable; and, c) a removable portion that is moveable from an in-use position in which the removable portion is mounted to the stationary base portion to a removed position in which the removable portion is removed from the stationary base portion, the removable portion comprising an air treatment assembly comprising an air treatment member, the air treatment member is positioned upstream of the pre-motor filter when the removable portion is in the in use position, wherein, the pre-motor filter comprises an annular filter media with a downstream interior air flow passage.

18. The evacuation station of claim 17 wherein the pre-motor filter is removable when the removable portion is removed from the stationary base portion.

19. The evacuation station of claim 17 wherein, in use, air travels downwardly into the pre-motor filter chamber.

20. The evacuation station of claim 17 wherein the pre-motor filter is positioned above a suction motor when the pre-motor filter is positioned in the pre-motor filter chamber.

* * * * *